United States Patent [19]

Funk

[11] Patent Number: 4,468,232

[45] Date of Patent: Aug. 28, 1984

[54] PROCESS FOR PREPARING A CLEAN COAL-WATER SLURRY

[75] Inventor: James E. Funk, Alfred Station, N.Y.

[73] Assignee: Alfred University Research Foundation, Inc., Alfred, N.Y.

[21] Appl. No.: 517,848

[22] Filed: Jul. 27, 1983

Related U.S. Application Data

[63] Continuation-in-part of Ser. No. 375,183, May 5, 1982, , which is a continuation-in-part of Ser. No. 88,815, Oct. 26, 1979, Pat. No. 4,282,006, which is a continuation-in-part of Ser. No. 957,166, Nov. 2, 1978, abandoned, which is a continuation-in-part of Ser. No. 790,337, Apr. 25, 1977, abandoned.

[51] Int. Cl.[3] ..... C10L 1/32

[52] U.S. Cl. ..... 44/51; 406/197

[58] Field of Search ..... 44/51; 406/197

[56] References Cited

U.S. PATENT DOCUMENTS 4,104,035 8/1978 Cole et al. ..... 44/51

4,282,006 4/1981 Funk ..... 44/51

*Primary Examiner*—Charles F. Warren

*Assistant Examiner*—Y. Harris-Smith

*Attorney, Agent, or Firm*—Howard J. Greenwald

[57] ABSTRACT

A process for providing a clean coal-water slurry, which contains from 60–80 volume percent of coal and has a relatively low viscosity, is provided. In one embodiment of this process, a coal-water mixture which contains 60–80 volume percent of solid material is ground until a slurry whose particle size distribution is in accordance with a specified CPFT formula is produced, and the coal is cleaned; in this embodiment, the coal is cleaned either by cleaning the coal-water mixture before grinding it, or by cleaning the coal-water slurry. In another embodiment of this process, a coal-water mixture is blended with at least one additional coal fraction(such as coal, coal-water mixture, or mixtures thereof) until a slurry is produced which contains 60–80 percent of solids and which has the aforementioned particle size distribution; and the coal is cleaned; in this embodiment, it is preferred to clean the coal by cleaning the coal-water slurry.

15 Claims, 5 Drawing Figures

PROCESS FOR PREPARING A CLEAN COAL-WATER SLURRY

CROSS-REFERENCE TO RELATED APPLICATIONS

This application is a continuation-in-part of applicant's copending application Ser. No. 375,183 filed May 5, 1982, which was a continuation-in-part of application Ser. No. 088,815 filed Oct. 26, 1979, (now U.S. Pat. No. 4,282,006), which was a continuation-in-part of application Ser. No. 957,166 filed Nov. 2, 1978 (now abandoned) which was a continuation-in-part of application Ser. No. 790,337 filed Apr. 25, 1977 (now abandoned).

TECHNICAL FIELD

A process for providing a clean coal-water slurry, which contains from 60–80 volume percent of coal and has a relatively low viscosity, is provided. In one embodiment of this process, a coal-water mixture which contains 60–80 volume percent of solid material is ground until a slurry whose particle size distribution is in accordance with a specified CPFT formula is produced, and the coal is cleaned; in this embodiment, the coal is cleaned either by cleaning the coal-water mixture before grinding it, or by cleaning the coal-water slurry. In another embodiment of this process, a coal-water mixture is blended with at least one additional coal fraction (such as coal, coal-water mixture, or mixtures thereof) until a slurry is produced which contains 60–80 percent of solids and which has the aforementioned particle size distribution, and the coal is cleaned; in this embodiment, it is preferred to clean the coal by cleaning the coal-water slurry.

BACKGROUND OF THE INVENTION

U.S. Pat. No. 4,282,006 discloses a high solids content, low-viscosity slurry comprised of carbonaceous solid material (such as coal) and liquid which can be pumped like a liquid and burned in a manner similar to the way oil is burned. The vast deposits of coal in the United States, the fact that such a coal-liquid slurry might be substantially cheaper than an equivalent amount of oil, and the need for the United States to reduce its dependence upon foreign oil indicate that such a slurry might be very important to this nation's economy.

Ideally, a slurry containing carbonaceous material and liquid should be stable under the dynamic conditions it might encounter during pumping and shipping. In the transportation of such a slurry, (such as by barge, marine tanker, rail car, or truck tank car) various stresses might be encountered. The vibrations the slurry will be subjected to will vary in both amplitude and frequency. Thus, for example, during shipboard travel when there is relatively little clearance between the hull and the harbor or river bottom, severe shaking of the ship will be caused by pressure waves from the ship's propellers. When shipboard travel occurs on the open water, by comparison, there will be more roll, and some pitch, but the amount of high frequency vibration should be relatively small. The amount of motion a slurry is subjected to during any type of travel should vary with the extent of confinement of the slurry: full tanks would slosh very little, and partially empty tanks would slosh considerably more.

One problem encountered with many prior art coal-water slurries is that they become unmixed when they are subjected to vibration, with disastrous consequences. When such a slurry is being pumped, the solid particles settle out of the slurry to the bottom of the pipe, thereby changing the solids content and other properties of the slurry, clogging the pipe, and impeding the fluid flow of the slurry; often a hard pack of solid material is formed which is difficult or impossible to readily resuspend in the slurry.

It is probable that, to some extent, some settling will occur in coal-liquid slurries subjected to vibratory conditions. It is desirable to minimize the degree of settling. It is also desirable to provide a slurry wherein, even if settling does occur, the settled particles form a "soft pack" (as opposed to a hard pack) and can be easily resuspended in the slurry.

It is an object of this invention to provide a clean high-solids content slurry with low viscosity comprised of carbonaceous material and liquid which has improved dynamic stability properties, in which the amount of settling caused by vibratory conditions is minimized, and whose deposits formed after having been subjected to vibratory conditions can be relatively easily resuspended.

SUMMARY OF THE INVENTION

A process for providing a clean coal-water slurry, which contains from 60–80 volume percent of coal and has a relatively low viscosity, is provided. In one embodiment of this process, a coal-water mixture which contains 60–80 volume percent of solid material is ground until a slurry whose particle size distribution is in accordance with a specified CPFT formula is produced, and the coal is cleaned; in this embodiment, the coal is cleaned either by cleaning the coal-water mixture before grinding it, or by cleaning the coal-water slurry. In another embodiment of this process, a coal-water mixture is blended with at least one additional coal fraction (such as coal, coal-water mixture, or mixtures thereof) until a slurry is produced which contains 60–80 percent of solids and which has the aforementioned particle size distribution; and the coal is cleaned; in this embodiment, it is preferred to clean the coal by cleaning the coal-water slurry.

BRIEF DESCRIPTION OF THE DRAWINGS

The present invention will be more fully understood by reference to the following detailed description hereof, when read in conjunction with the attached drawings, wherein like reference numbers refer to like elements and wherein.

DETAILED DESCRIPTION OF THE INVENTION

Figure 1:
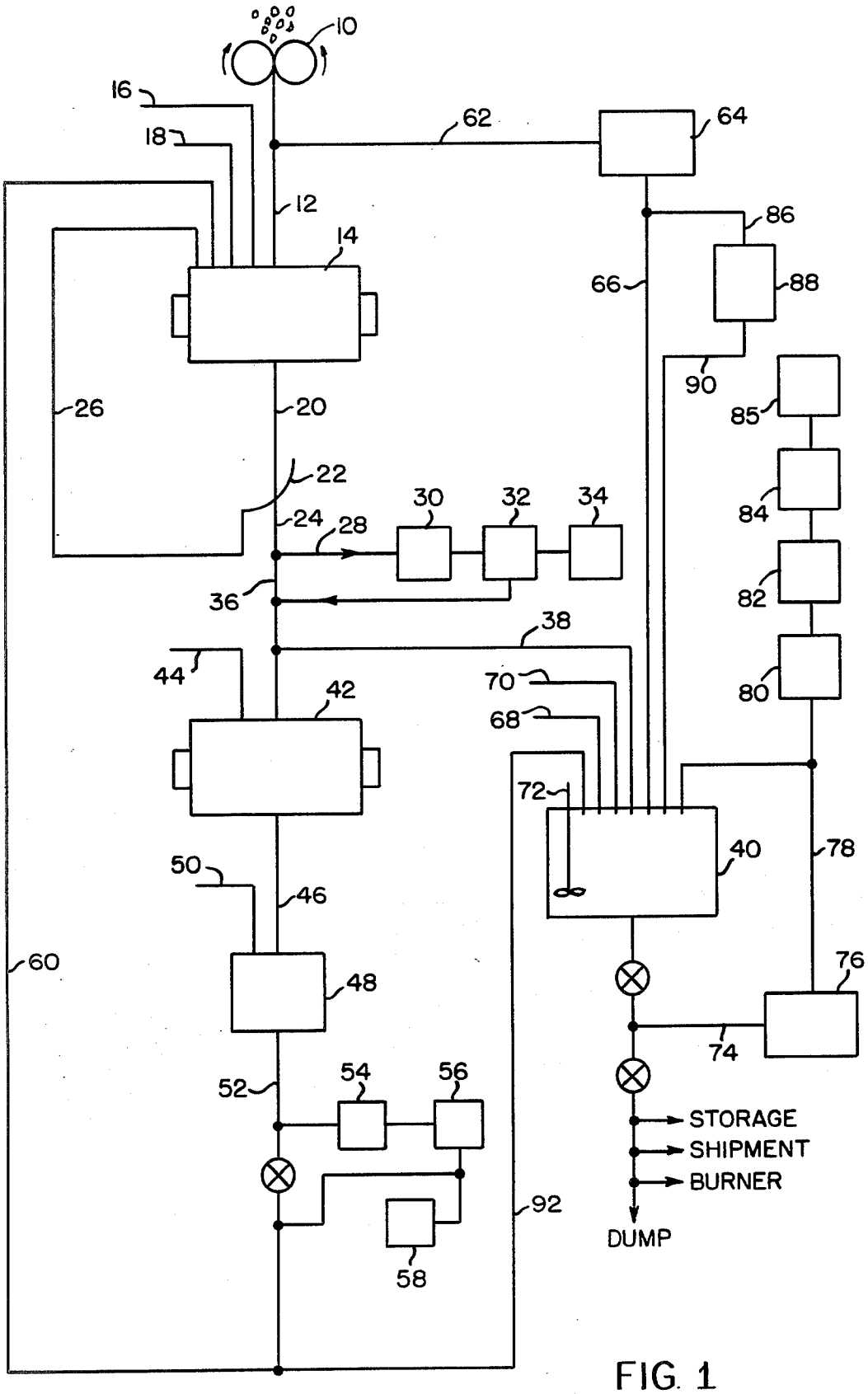
FIG. 1 is a flow sheet of a preferred process for preparing the stable slurry of this invention.

The slurry produced by the process of this invention preferably has both static and dynamic stability; it is preferably capable of maintaining its level of homogeneity over an extended period of time, and its physical state preferably neither readily changes nor undergoes fluctuations which substantially impair its use. In particular, the preferred slurry of this invention does not form a substantial amount of "hard pack" deposit when subjected to vibration encountered during shipping, it is easy to resuspend after having been subjected to said vibration conditions, it undergoes a minimum of syneretic settling, and it undergoes a minimum of particles separation.

The dynamic stability properties of the preferred slurry of this invention make it especially useful for applications where it must be pumped and/or shipped. In general, when 250 cubic centimeters of the preferred slurry of this invention is poured into a 75 cm long 2 cm inside diameter cylinder, the cylinder containing the slurry is subjected to a stress of 2 gravities, a frequency of 600 rpm, and an amplitude of 0.168 inches for 480 minutes in the test apparatus described in FIG. 3 of this specification, and the solids contents of the slurry in the top inch of said cylinder and the bottom inch of said cylinder are determined, the solids content of the preferred slurry in the bottom of said cylinder (by weight) will not be more than about 5 percent greater than the solids content in the top of said cylinder. In a more preferred embodiment, said difference between the solid content between top and bottom portions of slurry in the cylinder is less than about 2.5 percent.

The slurry of this invention is preferably comprised of at least one carbonaceous solid. As used in this specification, the term "carbonaceous" refers to a carbon-containing material and includes, e.g., coal, coke, graphite, and the like. The preferred carbonaceous materials are carbonaceous fuels.

In one preferred embodiment, the carbonaceous solid is coal. The kind of coal used for practice of the invention is not critical. Coals found in the United States, particularly low volatile bituminous coals from West Virginia, high volatile bituminous coals from Kentucky, Ohio, Arizona, or sub-bituminous coals from Montana fields have been used. Anthracite, semi-anthracite, medium, and high-volatile bituminous, sub-bituminous and lignite coals also may advantageously be used to practice the invention.

The coal for use in the process can be obtained in a dry or wet form and mixed with fluid to form a coal-fluid slurry. Preferably, the coal for making a fine particle sized fraction is wet milled in known ways to prevent dust and explosion hazards, while adding dispersing agent(s) to the fluid in accordance with this invention. The wet milled coal fraction can be milled with all the water, or it can be mixed with sufficient additional water to make a slurry which will be readily pumpable in a pipeline when it further is mixed with a coarser pulverized coal fraction to form a coal-water slurry.

In one preferred embodiment, the coal utilized in the coal-fluid slurry of this invention is "pulverized".

The term "pulverized coal" (or "P.C."), as used in this specification, refers to coal which has been milled or ground to a consist of about 40 mesh×0; see the Handbook of Chemistry and Physics, 51st Edition (CRC Publishing Co., Cleveland, Ohio, 1970–1971), page F-199, the disclosure of which is hereby incorporated herein by reference.

In view of the manner in which coal fractures during milling, coal particles will have irregular shapes which, however, are of a body (or maximum side-to-side thickness) such that the sub-sieve sized discrete particles will pass through a specified mesh of a sieve. The size of the discrete particle can be expressed in terms of a spherical diameter which, as used herein, is defined as a U.S. sieve size of from 16 mesh to 400 mesh (38 μm) or its equivalent in microns through which a coal particle from a sample of coal or coal-water slurry will pass. For particles finer than 200 mesh, the size of the particles can be expressed in mm as determined by means of a sieve, or a sedimentometer, or a scanning electron microscope (SEM).

In one preferred embodiment, the carbonaceous solid is coke. Coke is the carbonaceous residue (70–80%) of a carbonaceous material (such as coal) after the volatile components have been distilled off. Any coke known to those skilled in the art can be used in the slurry of this invention. Thus, for example, one can use coke formed when bituminous coal is heated in either a limited air supply or in the absence of air. Petroleum coke, made from the fractionation of oil, also can be used in the slurry of this invention.

Mixtures of carbonaceous solids also can be used in the slurry of this invention. By way of illustration and not limitation, one can use a mixture of a coarse carbonaceous fraction which contains less than about 30 weight percent of volatilizable hydrocarbons (such as, e.g., anthracite or low volatile bituminous coal) and a fine carbonaceous fraction which contains more than about 35 weight percent of volatilizable hydrocarbons (such as, e.g., lignite or high volatile bituminous coal). One can use a mixture of two or more of said coarse carbonaceous fractions and one of said fine fractions, one of said coarse carbonaceous fractions and two or more of said fine fractions, or two or more of said coarse carbonaceous fractions and two or more of said fine fractions.

The slurry of this invention is comprised of one or more liquids. As used in this specification, the term liquid refers to a substance which undergoes continuous deformation under a shearing stress. The liquid used in the slurry of this invention preferably performs at least two functions—it fills the interstitial pores of the carbonaceous solid material, and it provides the vehicle for separation of the particles of the carbonaceous solid material to minimize collisions between said particles; thus, the preferred liquid is a carrier liquid.

By way of illustration and not limitation, some of the liquids which can be used in the slurry of this invention includes water; waste industrial solvents such as, e.g., effluents from waste disposal plants, contaminated waste water containing hydrocarbons from e.g., oil-separation processes, and the like; aromatic and aliphatic alcohols containing 1–10 carbon atoms, such as methanol, ethanol, propanol, butanol, phenol, and the like; pine oil; petroleum liquids such as, e.g., number 2 fuel oil, number 4 fuel oil, number 6 fuel oil, gasoline, naphtha, and the like; hydrocarbon solvents such as, e.g., benzene, toluene, xylene, kerosene, and derivatives thereof; acetone; aniline; anisole; halobenzenes such as; e.g., bromobenzene and chlorobenzene; nitrobenzene; carbon tetrachloride; chloroform; cyclohexane; n-decane; dodecane; 1,1,2,2-tetrachloroethane; ethyl bromide; 1,2-dichloroethylene; tetrachloroethylene; trichloroethylene; ethylene chloride; ethyl ether; ethyl iodide; glycol; n-hendecane; n-heptane; 1-heptanol; 1-hexanol; methylene halides such as, e.g., methylene chloride, methylene bromide, and methylene iodide; n-octadecane; n-octane; 1-octanol; n-pentadecane; pentanol; and the like. The aforementioned list is merely illustrative, and those skilled in the art will recognize that many other liquids can be used in the slurry of this invention.

In one preferred embodiment, the liquid used in the slurry of this invention is carrier water. As used in this specification, the term "carrier water" means the bulk of free water dispersed between the coal particles and contiguous to the bound layers of the particles, and it is to be distinguished from bound water. The term "bound water" means water retained in the "bound water layer," as defined and illustrated in Kirk-Othmer, Encyclopedia of Chemical Technology, 2nd Edition, Vol. 22, pages 90–97 (at p. 91).

The kind of water used as carrier water in the coal-water slurry of this invention may be any available water, such as mine, well, river, or lake water or desalinated ocean water having a sufficiently low mineral salt content such that the electrochemistry of the bound water layer and carrier water interface can be controlled, in accordance with the invention and corrosion of milling facilities, pipe lines and furnaces will be minimized and controllable.

When water is added to a carbonaceous powder comprised of finely divided particles, and if the water "wets" the powder, a surface water film is adsorbed on each particle which is known to be structurally different from the surrounding "free" or bulk water, in that the film may be described as "semi-rigid", or "bound water film". Depending on the fundamental electrical potential of the surface, this "semi-rigid" or bound water film may be of several molecules thickness.

Mixtures of two or more liquids can be used in the slurry of this invention. Thus, by way of illustration and not limitation, one may use mixtures of water and ethanol, water and oil, water and gasoline, and the like. One can use mixtures comprised of from about 1 to about 99 volume percent of alcohol and from about 99 to about 1 volume percent of water. In one preferred embodiment, the mixture is comprised of from about 1 to about 15 volume percent of alcohol with the remainder of the liquid consisting essentially of water. It is preferred that the alcohol be liquid and monohydric and that it contain from about 1 to about 10 carbon atoms. Suitable monohydric alcohols are listed on page 265 of Fieser and Fieser's "Advanced Organic Chemistry" (Reinhold, N.Y., 1961), the disclosure of which is hereby incorporated by reference into this specification.

The slurry of this invention has a consist with a specific surface area of from about 0.8 to about 4.0 square meters per cubic centimeter. It is preferred that said specific surface area to be from about 0.8 to about 3.0 $m^2/cc$. It is more preferred that the specific surface area be from about 0.8 to about 2.4 $m^2/cc$. In an even more preferred embodiment, the specific surface area is from about 0.8 to about 2.0 $m^2/cc$.

As used in this specification, the term "specific surface area" refers to the summation of the surface area of equivalent spheres in the particle size distribution as measured by sieve analysis and sedimentation techniques; the particle size distribution of the consist in the slurry is first determined, it is assumed that all particles in the consist are spherical, and then one calculates the surface area based on this assumption. As used herein, the term "consist" refers to the particle size distribution of the solid phase of the solids-liquid slurry.

For any given consist, one can determine the particle size distribution by means well known to those skilled in the art. For measuring particle sizes and for determining particle size distributions of pulverized and fine grind coal particles used for preparing a coal-water slurry, the following two means of measuring particle sizes can be used and are preferred:

1. U.S. Series sieves Nos. 16, 20, 30, 40, 50, 70, 100, 140, 200, 270, is used to determine weights of coal particles passing through each sieve in the range of about (−) 1180 um to (−) 53 um. The cumulative volume percents of coal particles, dry basis, finer than (CPFT) a particular stated sieve size in microns is charted against the sizes in microns on a log-log chart, referred to herein as a "CPFT chart," to indicate the nature of the particle size distribution of 16 mesh×270 mesh particles.

2. A Sedigraph 5500L (made by Micromeritics, Co., Norcross, Ga., U.S.) is used to measure particle sizes and numbers of particles in coal and in the coal-water slurry in the range of (−) 75 μm to about 0.2 mm. The Sedigraph 5500L uses photo-extinction of settling particles dispersed in water according to Stoke's law as a means for making the above determinations. Other instruments, such as a Coulter Counter or combinations of the Leeds & Northrup Microtrac Particle Analyzers can also be used for similar accuracy. The results can be plotted on a CPFT chart. Although these data do not necessarily extend to the size axis at 1% CPFT, the "$D_s$ at 1%" can be determined by extrapolating the CPFT chart line to this axis and reading the intercept. This number, although not the true $D_s$ can be effectively used in the computer algorithm to determine % porosity and specific surface area.

In addition to the above methods, particle size measurements can be estimated from methylene blue index measurements to obtain an approximate determination of the wgt. % of colloidal particles of size below 1 mm. Such a procedure is described in A.S.T.M. Standard C837–76. This index can be compared with the surface area calculated by the CPFT algorithm.

Once the particle size distribution of the consist is determined, it is assumed that each particle in the consist is spherical with a surface area of $D^2$; the diameter D of the particles in each class of particles in the consist is known; and the surface area of the particles in each class is calculated and summed.

The slurry of this invention preferably has a yield stress of from about 3 to about 18 Pascals. It is preferred that the yield stress be from about 5 to about 15 Pascals, and it is more preferred that the yield stress be from about 7 to about 12 Pascals. As is known to those skilled in the art, the yield stress is the stress which must be exceeded before flow starts. A shear stress versus shear rate diagram for a yield pseudoplastic or a Bingham plastic fluid usually shows a non-linear hump in the rheogram at the onset of flow; extrapolating the relatively linear portion of the curve back to the intercept of the shear stress axis gives the yield stress. See, for example, W. L. Wilkinson's "Non-Newtonian Fluids, Fluid Mechanics, Mixing and Heat Transfer" (Pergamon Press, New York 1960), pages 1–9, the disclosure of which is hereby incorporated herein by reference. Also see Richard W. Hanks, et al's "Slurry Pipeline Hydraulics and Design" (Pipeline Systems Incorporated, Orinda, Calif., 1980), pages II-1 to II-10, the disclosure of which is also hereby incorporated herein by reference.

The consist used in the slurry of this invention has an interstitial porosity of less than about 20 percent. It is preferred that said interstitial porosity is less than about 15 volume percent, and it is more preferred that said interstitial porosity be less than about 10 percent. The interstitial porosity is a function of the volume between the interstices of the particles in the slurry consist. For any given space full of particles, the interstitial porosity is equal to the "minimum theoretical porosity" in accordance with the equation presented below.

Minimum Theoretical Porosity=40% (1−[1/VA]) where VA is as defined by the following modified Westman-Hugill algorithm:

$$VA_1 = A_1X_1$$

$$VA_2 = X_1 + A_2X_2$$

$$VA_3 = X_1 + X_2 + A_3X_3$$

$$\vdots$$

$$VA_i = \sum_{j=1}^{i-1} X_j + A_iX_i$$

$$\vdots$$

$$VA_n = \sum_{j=1}^{n=1} X_j + A_nX_n$$

wherein:

$A_i$=Apparent volume of a monodispersion of the $i^{th}$ size particle, $X_i$=Mass fraction of the $i^{th}$ size particles, $VA_i$=Apparent volume calculated with reference to the $i^{th}$ size particles, n=Number of particle sizes, and VA=Maximum value of $VA_i$=Apparent volume of the mixture of n particle sizes.

To determine the interstitial porosity of any consist, the particle size distribution of said consist can be determined by the method described above with reference to the measurement of the specific surface area. Thereafter, it is assumed that each particle in the consist is spherical, the volume of the particles is calculated in accordance with this assumption, and the interstitial porosity of the consist is then calculated in accordance with the above formula. It is noted that this calculated porosity is less than the true porosity of a consist as measured, for example, by liquid loss due to the non-spherical morphology (shape) of the particles, and by invocation of $D_s$ at 1%.

The slurry of this invention has a relatively low viscosity even though it has a high solids content. The Brookfield viscosity of the slurry is tested after the solids concentration of the slurry is adjusted to a solids content of 70 volume percent (the slurry is either diluted or concentrated until it has this concentration of solids), ambient temperature, ambient pressure, and a shear rate of 100 revolutions per minute. Under these test conditions, the viscosity of the slurry is less than about 5,000 centipoise. It is preferred that the viscosity of the slurry be less than about 4,000 centipoise. It is more preferred that the viscosity of the slurry be less than about 3,000 centipoise. In an even more preferred embodiment, the viscosity of the slurry is less than about 2,000 centipoise. In the most preferred embodiment, the viscosity of the slurry is less than about 1,000 centipoise.

As used in this specification, the term "Brookfield viscosity" describes viscosity as measured by conventional techniques by means of a Brookfield Synchro-Lectric Viscosimeter (manufactured by the Brookfield Engineering Laboratories, Stoughton, Mass., U.S.A.).

The slurry of this invention contains at least 60 volume percent of solids, by volume of slurry, measured on a dry basis. It is preferred that the slurry contain at least 70 volume percent of solids, dry basis; and it is more preferred that the slurry contain at least 80 volume percent of solids, dry basis.

As used herein, the term solids refers to solid carbonaceous material (such as coal and/or coke) which can include impurities. Thus, for example, with reference to coal, the term "solids" includes the as-mined coal which may include, e.g., coal and ash. There is a considerable amount of bound water in coal as mined; the volume of this water in the coal is not included in the solids weight in order to calculate the volume percent of "dry" solids in the slurry of this invention. As used herein, the term "dry basis" refers to coal which is substantially free of carrier water. Coal is considered to be dry after it has been air dried by being exposed to air at a temperature of at least 70 degrees Fahrenheit and a relative humidity of less than 50 percent for at least 24 hours.

The slurry of this invention contains a substantial amount of carbonaceous solid material(s) and less than 40 volume percent (by volume of slurry) of liquid. It is preferred that the slurry contain less than about 30 volume percent of liquid. In the most preferred embodiment, the slurry contains less than about 20 volume percent liquid.

The slurry of this invention contains from about 0.01 to about 4.0 weight percent of dispersing agent, based upon the weight of dry materal. Mean for determining the identity of the most effective dispersing agent for a given slurry will be described below for a coal-water slurry, it being understood that the technique described is applicable to other slurries such as, e.g., coke-water, graphite-water, etc.

In general, for any given slurry system, the identity of effective dispersing agents can be determined by measuring the effects of the dispersant upon the system at a given dispersant concentration; viscosity versus shear rate of the stirred coal-water slurry is measured while titrating with increasing amounts of the dispersing agent, and the point at which the slurry viscosity ceases to decrease is noted. For any given dispersant(s), and slurry system, the most effective concentration is the one which gives the minimum viscosity under a given set of test conditions, and the efficiency of different dispersants can be compared by testing them with a given slurry system under comparable concentration and test conditions. Thus, for example, one can dry grind a sample of coal in a laboratory size ball mill with porcelain or steel balls in water at 50 weight percent solids, e.g., for 24 hours or until all of the particles in the coal are less than 10 microns in size; other grinding devices known to those skilled in the art may also be used such as vibroenergy mills, stirred ball mills, or fluid energy mills. Small samples (about 500 milliliters apiece) of the slurry can then be deflocculated by adding various dispersing agents to the samples dry or preferably in solution dropwise, blending the mixture at any consistent blending energy (which may be gentle as mixing by hand, or at very high shear energy which will improve dispersion), and then measuring the viscosity at some constant shear rate by, e.g., using a Brookfield RVT viscometer at 100 revolutions per minute. The dispersing agent (or combination of dispersing agents) which is found to produce the lowest viscosity for the system at a given shear rate and dispersing agent(s) concentration is the most effective for those conditions. This technique is described in detail in my U.S. Pat. No. 4,282,006, the disclosure of which is hereby incorporated herein by reference.

Figure 5:
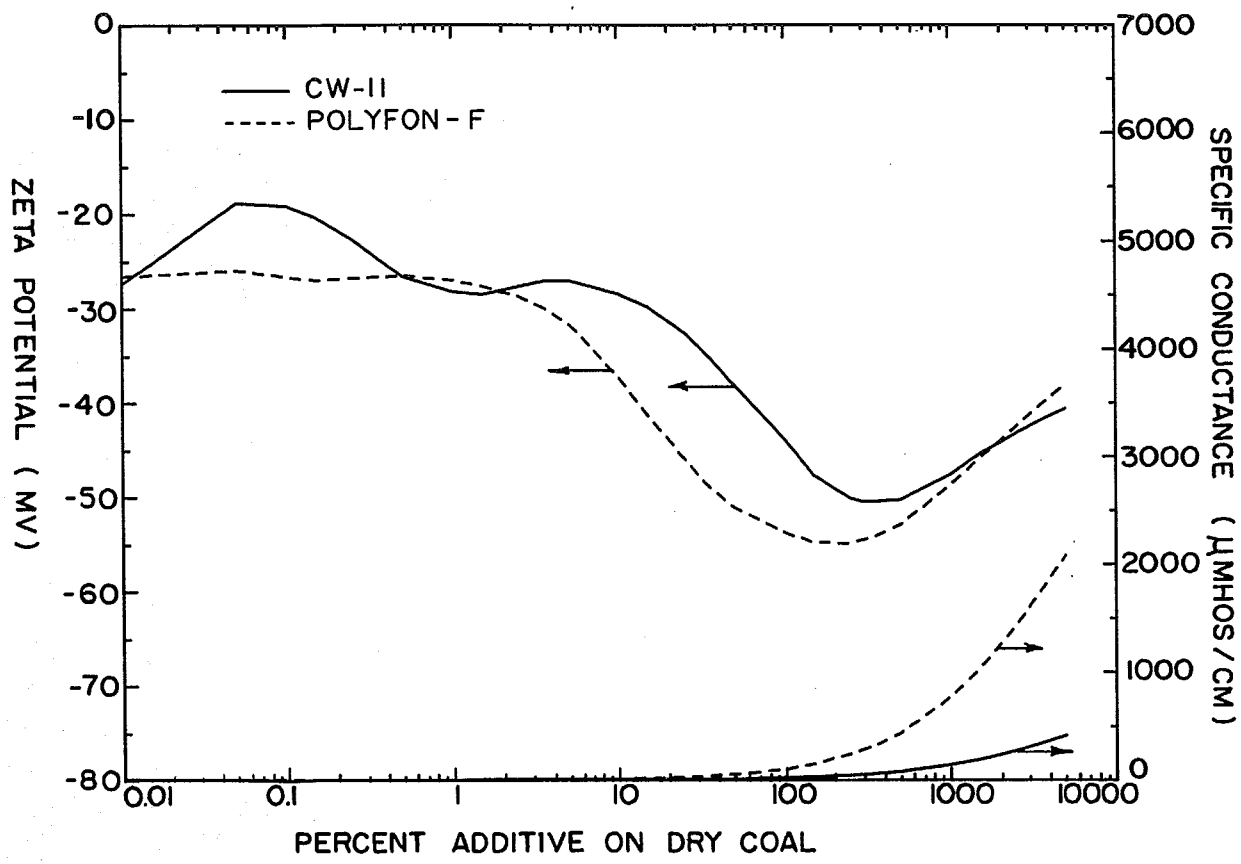
FIG. 5 is a chart showing the correlation between the zeta potential of coal particles in a fluid and the specific conductance of the fluid as a function of percent dispersing agent added to the fluid for two candidate dispersants.

FIG. 5 illustrates one means of evaluating the effectiveness of surfactants for any given solid material. The curves of FIG. 5 represent data obtained using both a purported nonionic polymer CW-11 made by the Diamond Shamrock Process Chemicals Co. and an anionic lignosulfonate Polyfon-F made by Westvaco, Inc. adsorbed on an Australian coal. The fine coal ground to about 100% finer than 10 microns is slurried in distilled water at 0.01 weight percent solids. Aliquots are placed in test tubes and increasing amounts of any candidate surfactant is added to each test tube. The test tube samples are thoroughly mixed and inserted into a sampler carousel. The Pen Kem System 3000 Electrophoretic Mobility Analyzer automatically and sequentially samples each test tube and measures the electrophoretic mobility of the coal particles and the specific conductance of the carrier liquid. pH can also be measured on each sample. In FIG. 5 the left ordinate gives the calculated zeta potential of the particles in millivolts, the right ordinate gives the specific conductance in micromhos of the carrier liquid. These variables are both measured as a function of the percent addition of each surfactant on a dry coal basis which is plotted on the abscissa. FIG. 5 shows that the purported nonionic CW-11 surfactant does have some anionic character. CW-11 has a zeta potential of −50 mv at 300% addition 0.01% dry coal. Polyfon-F has a zeta potential of −55 mv at 200% addition on 0.01% dry coal. Furthermore the specific conductance of the Polyfon-F at −55 mv zeta potential is greater than CW-11 at −50 mv. These data establish Polyfon-F as a more chemically effective surfactant for use on this particular Australian coal.

The amount of dispersing agents used will vary, depending upon such factors as the concentration of the coal in the slurry, the particle size and particle size distribution, the amount of ash minerals (i.e. clays and other minerals present), the temperature of the slurry, the pH, the original zeta potential of the particles, and the identity of the dispersing agent(s) and its concentration. In general, the dispersing agent is present in the slurry, at from 0.01 to 4.0 weight percent based on the weight of dry coal. Procedurally, in determining the amount of a specific dispersing reagent needed, a series of measurements can be made of viscosities versus shear rates versus zeta potential for a series of solids-liquid slurries containing a range of amounts of a particular dispersing agent for a constant amount of solids-liquid slurry. The data can be plotted and used as a guide to the optimum quantities of that agent to use to obtain near maximum or maximum zeta potential for that slurry system. The coordinate of the chart at which the viscosity and/or zeta potential is not changed significantly by adding more agent is selected as an indication of the optimum quantity at maximum zeta potential, and the amount is read from the base line of the chart. The viscosity and amount read from the titration chart is then compared with an equivalent chart showing a correlation among viscosity, amount, and maximum zeta potential. An amount of electrolyte and/or dispersing agent(s) required to provide a maximum or near maximum zeta potential and a selected viscosity can then be used to make solids-liquid slurry.

It is preferred that the slurry of this invention be comprised of an amount of dispersing agent effective to maintain the particles of material in dispersed form in the carrier liquid of the slurry, to generate a yield stress in the slurry of from about 3 to about 18 Pascals, and to charge the colloidal coal particles in the slurry to a net zeta potential of from about 15 to about 85 millivolts. It is preferred that the slurry of this invention contain from about 0.01 to about 4.0 percent, based on weight of dry solids, of at least one dispersing agent. It is more preferred that the slurry contain from about 0.03 to about 1.8 percent, based on weight of dry solids, of dispersing agent. In an even more preferred embodiment, the slurry contains from about 0.05 to about 1.4 percent, by weight of dry solids, of dispersing agent. In the most preferred embodiment, the slurry contains from about 0.10 to about 1.2 percent of dispersing agent.

It should be noted, however, that the use of the optimum amount of dispersing agent(s) does not, in and of itself, guarantee that the slurry system will have dynamic stability. Other factors, such as the slurry's specific surface, porosity, and its solids content, must also be taken into consideration, and these factors should be interrelated in the manner specified in this specification.

Any dispersing agent which disperses the coal particles in the water and imparts the specified yield stress and zeta potential values to the slurry can be used. As is known to those skilled in the art, the dispersing agent can be inorganic. Thus, for example, sodium hydroxide can be used with some coal. The dispersing agent can be, and preferably is, organic, i.e., it contains carbon. The dispersing agent is preferably an anionic organic surfactant.

It is preferred that the dispersing agent used in the slurry of this invention be an organic compound which encompasses in the same molecule two dissimilar structural groups, e.g., a water soluble moiety, and a water insoluble moiety. It is preferred that said dispersing agent be a surfactant. The term "surface-active agent", or "surfactant", as used in the prior art indicates any substance that alters energy relationships at interfaces, and, in particular, a synthetic or natural organic compound displaying surface activity including wetting agents, detergents, penetrants, spreaders, dispersing agents, foaming agents, etc.

The surfactant used in the slurry of this invention is preferably an organic surfactant selected from the group consisting of anionic surfactants, cationic surfactants, and amphoteric surfactants. It is preferred that the surfactant be either anionic or cationic. In the most preferred embodiment, the surfactant is anionic.

It is preferred that the molecular weight of the surfactant used in the slurry of this invention be at least about 200. As used herein, the term "molecular weight" refers to the sum of the atomic weights of all the atoms in a molecule.

In one preferred embodiment, the surfactant is anionic and its solubilizing group(s) is selected from the group consisting of a carboxylate group, a sulfonate group, a sulfate group, a phosphate group, and mixtures thereof. By way of illustration, one of these preferred anionic surfactants is a polyacrylate having the general formula.

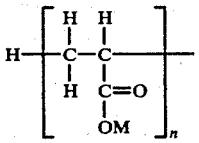

wherein n is a whole number of at least 3 and M is selected from the group consisting of hydrogen, sodium, potassium, and ammonium.

In another preferred embodiment, the surfactant is cationic and its solubilizing group(s) is selected from the group consisting of a primary amine group, a secondary amine group, a tertiary amine group, a quaternary ammonium group and mixtures thereof.

In yet another embodiment, the surfactant is amphoteric. In this embodiment, the surfactant has at least one solubilizing group selected from the group consisting of a carboxylate group, a sulfonate group, a sulfate group, a phosphate group, and mixtures thereof; and the surfactant also has at least one solubilizing group selected from the group consisting of a primary amine group, a secondary amine group, a tertiary amine group, a quaternary ammonium group, and mixtures thereof.

In one of the more preferred embodiments, the surfactant used in the slurry of this invention is comprised of at least about 85 weight percent of a structural unit of the formula.

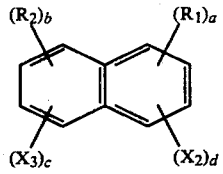

wherein $R_1$ and $R_2$ are independently selected from the group consisting of alkyl of from about 1 to about 6 carbon atoms and hydrogen; a, b, c, and d are integers independently selected from the group consisting of 0, 1, 2, 3, 4, 5, 6, 7, and 8, and $X_2$ and $X_3$ are independently selected from the group consisting of a carboxylate group, a sulfonate group, a sulfate group, a phosphate group, a nitro group, a halo group selected from the group consisting of chloro, bromo, fluoro, and iodo, —CN, an alkoxy group containing from 1 to about 6 carbon atoms, and a group of the formula $—R_3 OR_4$ wherein $R_3$ and $R_4$ are an alkyl containing from about 1 to about 3 carbon atoms. The starting materials which can be used to prepare these surfactants are well known to those skilled in the art and include, e.g., naphthalene-α sulfonic acid (dihyrate), naphthalene-β-sulfonic acid (monohydrate), α-nitronaphthalene, β-nitronaphthalene, α-naphthylamine, β-naphthylamine, α-naphthol, β-naphthol, α-naphthoic acid, β-napthoic acid, α-chloronaphthalene, α-bromonaphthalene, β-bromonaphthalene, β-chloronaphthalene, α-naphthonitrile, β-naphthonitrile, 1,5-dinitronaphthalene, 1,8-dinitronaphthalene, β-methylnaphthalene, 1-nitro-2-methylnaphthalene, 2-methylnaphthalene-6-sulfonic acid, 2,6-dimethylnaphthalene, β-6-methylnaphtholpropionic acid, 1,6-dibromo-2-naphthol, 6-bromo-2-naphthol, 1,6-dibromonaphthalene, 6-bromo-2-naphthol, and the like. Again, it is preferred that at least one of the atoms in this surfactant be an alkali metal selected from the group consisting of sodium, potassium, ammonium, and mixtures thereof. One of the most preferred surfactants from this group is the alkali metal salt of a condensed mono maphthalene sulfonic acid. This acid, whose preparation is described in U.S. Pat. No. 3,067,243 (the disclosure of which is hereby incorporated by reference into this specification), can be prepared by sulfonating naphthalene with sulfuric acid, condensing the sulfonated naphthalene with formaldehyde, and then neutralizing the condensate so obtained with sodium hydroxide. This alkali or $NH_4^+$ metal salt of a condensed mono naphthalene sulfonic acid is comprised of at least about 85 weight percent of a repeating structural unit of the formula

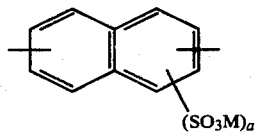

wherein M is an alkali metal selected from the group consisting of sodium, potassium, and ammonium and a is an integer of from 1 to 8. Comparable compounds with a benzene rather than naphthalene nucleus also can be used.

Examples of anionic organic surfactants which have been found particularly advantageous for providing yield pseudoplastic rheological properties to coal-water slurries, particularly those containing about 65 to 85 weight % of West Virginia or Black Mesa, Arizona coal, are shown in Table 1. In some cases, mixtures of two or more of these surfactants beneficially can be used.

TABLE 1

| Anionic Organic Surfactant | Tradename | Form | % conc. |
|---|---|---|---|
| 2-ethylhexyl polyphosphoric ester acid anhydride | Strodex MO-100 | Liquid | 100 |
| Potassium Salt of MO-100 | Strodex MOK-70 | Paste | 70 |
| Complex organic polyphosphoric ester acid anhydride | Strodex MR-100 | Liquid | 100 |
| Complex organic polyphosphoric ester acid anhydride | Strodex SE-100 | Liquid | 100 |
| Complex organic polyphosphoric ester acid anhydride | Strodex P-100 | Liquid | 100 |
| Complex organic polyphosphoric ester acid anhydride | Strodex PK-90 | Liquid | 90 |
| Potassium salt of complex organic polyacid anhydride | Strodex MRK-98 | Liquid | 98 |
| Potassium salt of complex organic polyacid anhydride | Strodex SEK-50 | Liquid | 50 |
| Potassium salt of complex organic polyacid anhydride | Strodex PSK-58 | Liquid | 58 |
| Potassium salt of complex organic polyacid anhydride | Strodex V-8 | Liquid | 85 |
| Sodium salt of condensed mono naphthalene sulfonic acid | Lomar D Lomar NCO Lomar PW | Powder | 86–90 |
| Sodium salt of condensed mono naphthalene sulfonic acid | Lomar LS | Powder | 95 |
| Ammonia salt of condensed mono naphthalene sulfonic acid | Lomar PWA | Powder | 89 |
| Solution of sodium salt of condensed mono naphthalene sulfonic acid | Lomar PL | Liquid | 45 |
| Sodium salt of a carboxylated polyelectrolyte | Daxad 30 | Liquid | 25 |

Strodex is a trademark of Dexter Chemical Corporation.

Lomar is a trademark of Diamond Shamrock Process Chemicals, Inc.

Daxad is a trademark of W. R. Grace & Co. Organic Chemicals Division.

Some preferred surfactants are selected from the group consisting of:

(i) 2-ethylhexyl polyphosphoric ester acid anhydride and its potassium salt.

(ii) complex organic polyphosphoric ester acid anhydride and its potassium salt.

(iii) condensed mononaphthalene sulfonic acid and its sodium and ammonium salts, and (iv) polymerized substituted phenyl propanes and their salts (lignosulfonates)

(v) copolymers of acrylic acid and ethylene sulfonates (vi) mixtures thereof

While the use of the sodium, potassium or ammonium salts of condensed mononaphthalene sulfonic acid is preferred, it is to be understood that the condensed mononaphthalene sulfonic acid can be used with the addition of sodium, potassium, or ammonium alkali to form the corresponding alkali metal salt of that acid in situ.

One of the more preferred surfactants is "Nopcosperse-VFG," an anionic surfactant which is available from the Diamond Shamrock Process Chemicals Division of Diamond Shamrock Corporation, Morristown, N.J. Another of the more preferred surfactants is of the formula

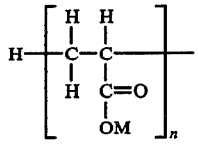

wherein M is alkali metal (and most preferably is sodium) and n is less than 200 and, preferably, less than 100.

Yet another of the preferred surfactants is an anionic, alkylaryl sulfonate which is liquid and has an HLB number of from about 8.0 to 15.0.

Yet another preferred surfactant is a lignin-based dispersing agent which is water soluble and which contains a sulfite lignin which ranges in molecular weight from about 1,000 to about 50,000 and whose basic lignin unit is a substituted phenylpropane. This lignin can be generated by the acid sulfite wood pulping process.

Yet another preferred surfactant is a lignin-based dispersing agent which is water-soluble and which contains an alkali lignin isolated from sulfate pulping black liquor generated in the alkaline sulfate wood pulping process.

Yet another class of preferred surfactant is a complex polymerized organic salt of sulfonic acids of the alkylaryl type such as, e.g., sodium naphthalene sulfonic acid formaldehyde, sodium salts of polymerized alkyl naphthelene sulfonic acid, and the like. One preferred species within this class is Darvan No. 1, a dispersing agent sold by the R. T. Vanderbilt Company, Inc. of Norwalk, Conn. which has a pH of from 8.0 to 10.5 (in one percent solution).

Yet another preferred surfactant class is the class of alkali metal (sodium) salts of polymerized benzoid alkyl sulfonic acids. One of the species within this class is Darvan No. 2 (available from said R. T. Vanderbilt Company) which has a pH (in one percent solution) of from about 7.8 to about 10.4.

Another preferred class of surfactants is the lignosulfonates. These lignosulfonates have an equivalent weight of from about 100 to about 350, contain from about 2 to about 60 phenyl propane units (and, preferably, from about 3 to 50 phenyl propane units), and are made up of cross-linked polyaromatic chains. Some of the preferred lignosulfonates include those listed on page 293 of McCutcheon's "Emulsifiers and Detergents), North American Edition (McCutcheon Division, MC Publishing Co., Glen Rock, N.J., 1981) and in the other portions of McCutcheon's which describes said lignosulfonates, the disclosure of which is hereby incorporated by reference into this specification. In one preferred embodiment, the lignosulfonate surfactant contains from about 0.5 to about 8.0 sulfonate groups. In this preferred embodiment, one species has 0.5 sulfonate groups, one has one sulfonate group, one has two sulfonate groups, and one has four sulfonate groups, and one has 7.5 sulfonate groups.

Applicant does not wish to be bound to any particular theory. However, he believes that a dispersing agent in a slurry according to his invention might perform at least three functions. In the first place, it is believed that a water soluble dispersing agent, which also serves as a wetting agent (such as an organic surfactant), functions to promote the wettability of the coal particles by water. As used herein, the term "wetting" indicates covering or penetrating the coal particle surface with a bound water layer. Such a wetting agent might or might not be needed, depending upon the surface chemistry of the coal, its hydrophobicity, and the associated electrochemistry of its inherent bound water layers. For example, inherent bed moisture and chemical compounds already present in natural coal deposits may allow wetting of the ground coal by added water.

In the second place, a dispersing agent might function to promote deflocculation of coal particles, preferably in the presence of advantageous electrolytes. As used herein, the term "deflocculating" indicates dispersion of particles, preferably of colloidal sized coal particles. Thus, e.g., a "deflocculating agent" includes a dispersing agent which promotes formation of a colloidal dispersion of colloidal sized particles in a solids-liquid slurry. It has been found that the presence of large, monovalent cations—such as $Na^+$, $Li^+$, or $K^+$—tend to promote deflocculation of colloidal sized coal particles in a solids-liquid slurry. However, higher valence cations—such as $Ca^{+2}$, $Al^{+3}$, and $Mg^{+2}$—tend to cause said particles to flocculate under certain conditions. Consequently, an organic anionic surfactant which wets the coal particles and contains a residual $Na^+$ and/or $K^+$ and an $Li^+$ can be a very effective deflocculant for the coal-water slurry of this invention. agent enhances the pumpability of the coal-water slurry. It is believed that this effect occurs because of enhancement or inhibition of the bound, or semi-rigid, water layer because the dispersing agent provides a cation as a counterion for the bound water layer, thereby affecting the yield pseudoplastic index (slope of a plot of log viscosity versus log shear rate) of the mass. Preferably, the cation provided by the dispersing agent is $NH_4^+$, $Na^+$ and/or $K^+$. Consequently, it is preferred to incorporate an advantageous electrolyte, such as an ammonium or alkali metal base, into the coal-water slurry to increase deflocculation of the slurry and thus improve its yield pseudoplasticity. However, it should be noted that the incorporation of an alkaline earth metal base into the slurry is substantially ineffective in promoting deflocculation.

It is preferred that the dispersing agent(s) used in the slurry of this invention provide one or more ions to the slurry. As used in this specification, the term "ion" includes an electrically charged atom, an electrically charged radical, or an electrically charged molecule.

In one preferred embodiment, the dispersing agent(s) used in the slurry of this invention provides one or more counterions which are of opposite charge to that of the surface of the coal particles. The charge on the surface of the coal particles in water is generally negative, and thus it is preferred that said counterions have a positive charge. The most preferred positively charged ions are the sodium and potassium cations and the ammonium radical.

In one embodiment it is preferred that the dispersing agent(s) used in the slurry of this invention be a polyelectrolyte which, preferably, is organic. As used in this specification, the term "polyelectrolyte" indicates a polymer which can be changed into a molecule with a number of electrical charges along its length. It is preferred that the polyelectrolyte have at least one site on each recurring structural unit which, when the polyelectrolyte is in aqueous solution, provides electrical charge; and it is more preferred that the polyelectrolyte have at least two such sites per recurring structural unit. In a preferred embodiment, said sites comprise ionizable groups selected from the group consisting of ionizable carboxylate, sulfonate, sulfate, and phosphate groups. Suitable polyelectrolytes include, e.g., the alkali metal and ammonium salts of polycarboxylic acids such as, for instance, polyacrylic acid; the sodium salt of condensed naphthalene sulfonic acid; polyacrylamide; and the like.

In one preferred embodiment, the slurry of this invention contains from about 0.05 to about 4.0 weight percent by weight of dry solids in the slurry, of an electrolyte which, preferably, is inorganic. As used in this specification, the term "electrolyte" refers to a substance that dissociates into two or more ions to some extent in water or other polar solvent. This substance can be, e.g., an acid, base or salt.

In a more preferred embodiment, the slurry of this invention is comprised of from about 0.05 to about 2.0 weight percent of an inorganic electrolyte. In the preferred embodiment, said coal-water slurry is comprised of from about 0.1 to about 0.8 weight percent of said electrolyte. In the most preferred embodiment, the slurry contains from about 0.1 to about 0.5 percent of inorganic electrolyte.

Any of the inorganic electrolytes known to those skilled in the art can be used in the slurry of this invention. Thus, by way of illustration and not limitation, one can use the ammonia or alkali metal salt of hexametaphosphates, pyrophosphates, sulfates, carbonates, hydroxides, and halides. Alkaline earth metal hydroxides can be used. Other inorganic electrolytes known to those skilled in the art also can be used.

In one preferred embodiment, the inorganic electrolyte is of the formula $$M_aZ_b$$

wherein M is an alkali metal selected from the group consisting of lithium, sodium, potassium, rubidium, cesium, and francium; b is the valence of metal M; a is the valence of anion Z; and Z is an anion selected from the group consisting of hexametaphosphate, pyrophosphate, silicate, sulfate, carbonate, hydroxide, and halide anions. It is preferred that Z be selected from the group consisting of carbonate, hydroxide, and silicate anions. The most preferred electrolytes are selected from the group consisting of potassium carbonate, sodium hydroxide, and $Na_2SiO_3.9H_2O$.

It is preferred that the slurry of this invention contain both said dispersing agent(s) and said inorganic electrolyte(s) and that from about 0.05 to about 10.0 parts (by weight) of the inorganic electrolyte are present for each part (by weight) of the dispersing agent(s) in the slurry.

It is preferred that the total concentration of both the dispersing agent(s) and/or the inorganic electrolyte be from 0.05 to 4.0 weight percent.

In one preferred embodiment, the slurry of this invention is comprised of dispersing agent(s) and inorganic electrolyte agent(s) which, when dissolved in water provide electrically charged ions to the slurry. The amount of electrically charged ions preferably present in the slurry ranges from about 0.01 to about 2.5 weight percent, based upon weight of dry coal, and most preferably is from about 0.05 to about 2.0 weight percent. Said concentration of electrically charged ions can be calculated by first calculating the weights of the ions in each of the dispersing agent(s) and the electrolyte agent(s), adding said weight(s), and then dividing the total ion weight by the weight of the dry coal.

By way of illustration, in one embodiment 0.75 grams of sodium hydroxide and 0.75 grams of sodium decyl benzene sulfonate were added to a slurry comprised of 100 grams of dry coal. The weight of the sodium ion provided by the caustic was equal to $22/40\times0.75$ grams; and it equals 0.4125 grams. The weight of the sodium ion provided by the sodium decyl benzene sulfonate was equal to $22/294\times0.75$ grams; and it equals 0.0561 grams. The total weight of the sodium ion provided by both the caustic electrolyte and the sulfonate dispersing agent was 0.4686 grams. Thus, the slurry contained 0.468 weight percent of sodium ion.

The coal consist used in the slurry of this invention is comprised of at least about 5 weight percent of colloidal particles. As used herein, the term colloid refers to a substance of which at least one component is subdivided physically in such a way that one or more of its dimensions lies in the range of 100 angstroms and 3 microns. As is known, these are not fixed limits and, occasionally, systems containing larger particles are classified as colloids. See *Encyclopedia Of Chemistry,* 2d Edition, Clark et al (Reinhold, 1966), page 203, the disclosure of which is hereby incorporated herein by reference.

It is preferred that, in the coal consist used in the slurry of this invention, at least 5 weight percent of the coal particles are smaller than about 3 microns. It is preferred that from about 5 to about 70 weight percent of the coal particles in said coal consist be smaller than 3 microns. In one preferred embodiment, from about 5 to about 30 weight percent of the coal particles in said coal consist are smaller than 3 microns. In another preferred embodiment, from about 7 to about 20 weight percent of the coal particles in said coal consist are smaller than 3 microns.

The slurry of this invention comprises a compact of finely-divided carbonaceous particles dispersed in fluid such as, e.g., finely-divided coal particles dispersed in water. The term compact, as used in this specification, refers to a mass of finely-divided particles which are closely packed in accordance with this invention.

The particles in the compact of the slurry of this invention have a specified particle size distribution which is substantially in accordance with the following formulae:

$$\frac{CPFT}{100} = \sum_{j=1}^{k} \left[ X_j \left( \frac{D^{Nj} - D_{sj}^{Nj}}{D_{Lj}^{Nj} - D_{sj}^{Nj}} \right) \right]$$

$$\text{where } \sum_{j=1}^{k} X_j = 1.0$$

$$\text{and where if } D < D_{sj} \left( \frac{D^{Nj} - D_{sj}^{Nj}}{D_{Lj}^{Nj} - D_{sj}^{Nj}} \right) = 0.0$$

$$\text{and where if } D > D_{Lj} \left( \frac{D^{Nj} - D_{sj}^{Nj}}{D_{Lj}^{Nj} - D_{sj}^{Nj}} \right) = 1.0$$

wherein CPFT is the cumulative percent of the carbonaceous solid finer than a certain specified particle size D, in volume percent; k is the number of component distributions in the consist, is at least 1, and preferably is from about 1 to about 30; $X_j$ is the fractional amount of the component j in the consist, is less than or equal to 1.0, and the sum of all $X_j$'s in the consist is 1.0; n is the distribution modulus (or slope) of fraction j, is greater than about 0.001, preferably is from about 0.001 to about 10.0 and more preferably from 0.01 to about 1.0, and most preferably is from about 0.01 to about 0.5; D is the diameter of any particle in the consist and ranges from about 0.05 to about 1180 microns; $D_s$ is the diameter of the smallest particle in fraction j (as measured by extrapolating the CPFT chart line, if necessary, to one percent CPFT using data from sieve analyses plus the Micromeritics Sedigraph 5500L ) and is generally greater than 0.05 microns but is less than $D_L$, and no more than 0.05 volume percent of the particles in the slurry consist have a size less than 0.05 microns; $D_L$ represents the diameter of the largest particle in fraction j (sieve size or its equivalent), it ranges from about 15 to about 1180 microns, preferably is from about 30 to about 420 microns, and most preferably is from about 100 to about 300 microns; $D_L$ is the theoretical size modulus of the particle size distribution; when CPFT is plotted against time, the $D_L$ value is indicated as the intercept on the upper X axis of the CPFT/D plot. However, as is known to those skilled in the art, because of aberrations in grinding the coarse end of a particle size distribution, the actual top particle size is always larger than the $D_L$ obtained by, e.g., the particle size equation described in this case; thus, e.g., a $D_L$ size modulus of 250 microns will usually produce a particle distribution with at least about 98 percent of the particles smaller than 300 microns. Consequently, slurry of this invention has a compact with a particle size distribution which is substantially in accordance with the CPFT equation; minor deviations caused by the actual top size being greater than the $D_L$ are within the scope and spirit of this invention.

When k is 1, the aforementioned equation simplifies to:

$$\frac{CPFT}{100} = \frac{D^n - D_s^n}{D_L^n - D_s^n}$$

when k is 2, the equation becomes:

$$\frac{CPFT}{100} = \underbrace{X_1 \left( \frac{D^{N1} - D_{s1}^{N1}}{D_{L1}^{N1} - D_{s1}^{N1}} \right)}_{\text{I}} + \underbrace{X_2 \left( \frac{D^{NL} - D_{s2}^{N2}}{D_{L2}^{N2} - D_{s2}^{N2}} \right)}_{\text{II}}$$

wherein: $X_1+X_2=1.0$ (i.e., the sum of the fractional parts is equal to the whole); when D is less than or equal to $D_{s1}$, the first term in the parentheses (term I) is equal to 0.0; when D is greater than or equal to $D_{L1}$, the first term in the parentheses (term I) is equal to 1.0; when D is less than $D_{S2}$, the second term in the parentheses (term II) is equal to 0.0; when D is greater than $D_{L2}$, the second term in the parentheses (term II) is equal to 1.0.

The reason for the aforementioned constraints of the terms in parentheses I and II is that each of these terms refers to the equation of one of the two components.

In order to sum the fractional parts of the two component distributions, the above considerations must be included since particles of a certain size may be represented between the effective $D_S$ and $D_L$ of the total distribution but not between the $D_S$ or $D_L$ of one of the component distributions. Thus, the values in parentheses I and II are subject to the limitations that, when D is less than or equal to $D_S$, the value for the term is 0.0 and when D is greater than $D_{Lj}$, the value of the term is 1.0.

The equation given above for when k is 2 is simply the sum of two components where the fraction of component $j_1$ is $X_1$ and the fraction of component $j_2$ is $X_2$. Since, in this case, $X_1$ and $X_2$ make up the whole distribution, their sum must equal 1.0.

In accordance with the above reasoning, when k=3, the equation becomes:

$$\frac{CPFT}{100} = X_1 \left( \frac{D^{N1} - D_{s1}^{N1}}{D_{L1}^{N1} - D_{s1}^{N1}} \right) + X_2 \left( \frac{D^{N2} - D_{s2}^{N2}}{D_{L2}^{N2} - D_{s2}^{N2}} \right) + X_3 \left( \frac{D^{N3} - D_{s3}^{N3}}{D_{L3}^{N3} - D_{s3}^{N3}} \right)$$

When k=4, there is a fourth term in the equation equal to $$X_4\left(\frac{D^{N4}-D_{s4}^{N4}}{D_{L4}^{N4}-D_{s4}^{N4}}\right)$$

In one preferred embodiment, k=1. In this embodiment:

$$\frac{CPFT}{100}=\frac{D^n-D_s^n}{D_L^n-D_s^n}$$

$D_S$ represents the diameter of the smallest particle in the consist (as measured by the CPFT chart line extrapolated if necessary to 1% CPFT using data from sieve analysis plus the Micromeritics Sedigraph 5500L). being from about 0.05 to about 0.4 microns, more preferably from about 0.05 to about 0.25 microns, and most preferably from about 0.5 to about 0.20 microns. $D_L$ is the diameter of the largest particle in the compact, sieve size or its equivalent; $D_L$ ranges from about 15 to about 1180 microns, preferably is from about 30 to about 420 microns, and most preferably is from about 100 to about 300 microns; $D_L$ is the theoretical size modulus of the particle size distribution as determined in equation (1).

Tables 2, 3, 4, and 5 illustrate a few typical consists which can be made in accordance with the CPFT equation of this invention. For each of these tables, four different coal components with differing values of $D_L$, $D_s$, and n were mathematically evaluated in consists containing only one of said components, two of said components, three of said components, and four of said components; and the properties of these consists were mathematically determined.

TABLE 2

| k | Porosity % | SA m²/cc | | $D_L$ / $D_s$ / n | 840 / 0.5 / 1.0 % | 300 / 0.5 / 1.0 % | 74 / 0.5 / 0.4 % | 15 / 0.5 / 0.1 % |
|---|---|---|---|---|---|---|---|---|
| 1 | 15.17 | 3.17 | | | 0.00 | 0.00 | 0.00 | 100.00 |
| | 7.85 | 1.20 | | | 0.00 | 0.00 | 100.00 | 0.00 |
| 2 | 14.47 | 2.97 | | | 0.00 | 0.00 | 10.00 | 90.00 |
| | 11.25 | 2.18 | | | 0.00 | 0.00 | 50.00 | 50.00 |
| | 7.08 | 1.40 | | | 0.00 | 0.00 | 90.00 | 10.00 |
| | 14.20 | 2.86 | | | 0.00 | 10.00 | 0.00 | 90.00 |
| | 8.13 | 1.09 | | | 0.00 | 10.00 | 90.00 | 0.00 |
| | 9.43 | 1.65 | | | 0.00 | 50.00 | 0.00 | 50.00 |
| | 16.38 | 1.04 | | | 0.00 | 70.00 | 0.00 | 30.00 |
| | 14.20 | 2.85 | | | 10.00 | 0.00 | 0.00 | 90.00 |
| | 7.54 | 1.09 | | | 10.00 | 0.00 | 90.00 | 0.00 |
| | 9.38 | 1.61 | | | 50.00 | 0.00 | 0.00 | 50.00 |
| 3 | 13.45 | 2.67 | | | 0.00 | 10.00 | 10.00 | 80.00 |
| | 10.43 | 1.98 | | | 0.00 | 10.00 | 45.00 | 45.00 |
| | 6.63 | 1.29 | | | 0.00 | 10.00 | 80.00 | 10.00 |
| | 9.10 | 1.60 | | | 0.00 | 45.00 | 10.00 | 45.00 |
| | 5.59 | 1.01 | | | 0.00 | 45.00 | 40.00 | 15.00 |
| | 13.44 | 2.66 | | | 10.00 | 0.00 | 10.00 | 80.00 |
| | 10.42 | 1.97 | | | 10.00 | 0.00 | 45.00 | 45.00 |
| | 6.62 | 1.28 | | | 10.00 | 0.00 | 80.00 | 10.00 |
| | 13.15 | 2.55 | | | 10.00 | 10.00 | 0.00 | 80.00 |
| | 15.03 | 1.03 | | | 10.00 | 60.00 | 0.00 | 30.00 |
| | 9.06 | 1.57 | | | 45.00 | 0.00 | 10.00 | 45.00 |
| | 8.66 | 1.46 | | | 45.00 | 10.00 | 0.00 | 45.00 |
| 4 | 5.43 | 1.02 | | | 5.00 | 30.00 | 55.00 | 10.00 |
| | 12.33 | 2.35 | | | 10.00 | 10.00 | 10.00 | 70.00 |
| | 6.15 | 1.18 | | | 10.00 | 10.00 | 70.00 | 10.00 |
| | 8.42 | 1.50 | | | 15.00 | 20.00 | 30.00 | 35.00 |
| | 7.86 | 1.40 | | | 15.00 | 20.00 | 35.00 | 30.00 |
| | 8.00 | 1.40 | | | 15.00 | 30.00 | 20.00 | 35.00 |
| | 6.22 | 1.10 | | | 15.00 | 30.00 | 35.00 | 20.00 |
| | 7.21 | 1.24 | | | 15.00 | 35.00 | 20.00 | 30.00 |
| | 5.98 | 1.05 | | | 15.00 | 35.00 | 30.00 | 20.00 |

TABLE 2-continued

| k | Porosity % | SA m²/cc | | $D_L$ / $D_s$ / n | 840 / 0.5 / 1.0 % | 300 / 0.5 / 1.0 % | 74 / 0.5 / 0.4 % | 15 / 0.5 / 0.1 % |
|---|---|---|---|---|---|---|---|---|
| | 8.42 | 1.50 | | | 20.00 | 15.00 | 30.00 | 35.00 |
| | 7.86 | 1.40 | | | 20.00 | 15.00 | 35.00 | 30.00 |
| | 7.78 | 1.34 | | | 20.00 | 30.00 | 15.00 | 35.00 |
| | 6.98 | 1.19 | | | 20.00 | 35.00 | 15.00 | 30.00 |
| | 7.41 | 1.29 | | | 30.00 | 15.00 | 25.00 | 30.00 |
| | 6.82 | 1.19 | | | 30.00 | 15.00 | 30.00 | 25.00 |
| | 7.77 | 1.33 | | | 30.00 | 20.00 | 15.00 | 35.00 |
| | 7.19 | 1.23 | | | 35.00 | 15.00 | 20.00 | 30.00 |
| | 6.96 | 1.17 | | | 35.00 | 20.00 | 15.00 | 30.00 |

TABLE 3

| k | Porosity % | SA m²/cc | | $D_L$ / $D_s$ / n | 840 / 0.5 / 0.7 % | 300 / 0.5 / 0.7 % | 74 / 0.5 / 0.2 % | 15 / 0.5 / 0.01 % |
|---|---|---|---|---|---|---|---|---|
| 1 | 16.40 | 3.42 | | | 0.00 | 0.00 | 0.00 | 100.00 |
| | 9.18 | 1.73 | | | 0.00 | 0.00 | 100.00 | 0.00 |
| 2 | 14.62 | 2.91 | | | 0.00 | 0.00 | 30.00 | 70.00 |
| | 13.62 | 2.66 | | | 0.00 | 0.00 | 45.00 | 55.00 |
| | 12.91 | 2.49 | | | 0.00 | 0.00 | 55.00 | 45.00 |
| | 11.77 | 2.24 | | | 0.00 | 0.00 | 70.00 | 30.00 |
| | 13.22 | 2.47 | | | 0.00 | 30.00 | 0.00 | 70.00 |
| | 7.10 | 1.29 | | | 0.00 | 30.00 | 70.00 | 0.00 |
| | 11.29 | 2.00 | | | 0.00 | 45.00 | 0.00 | 55.00 |
| | 5.95 | 1.08 | | | 0.00 | 45.00 | 55.00 | 0.00 |
| | 9.84 | 1.69 | | | 0.00 | 55.00 | 0.00 | 45.00 |
| | 8.31 | 1.22 | | | 0.00 | 70.00 | 0.00 | 30.00 |
| | 13.15 | 2.43 | | | 30.00 | 0.00 | 0.00 | 70.00 |
| | 7.00 | 1.25 | | | 30.00 | 0.00 | 70.00 | 0.00 |
| | 10.44 | 1.78 | | | 50.00 | 0.00 | 0.00 | 50.00 |
| | 8.24 | 1.12 | | | 70.00 | 0.00 | 0.00 | 30.00 |
| 3 | 15.42 | 3.09 | | | 5.00 | 5.00 | 0.00 | 90.00 |
| | 14.36 | 2.78 | | | 5.00 | 15.00 | 0.00 | 80.00 |
| | 13.21 | 2.47 | | | 5.00 | 25.00 | 0.00 | 70.00 |
| | 13.20 | 2.46 | | | 10.00 | 20.00 | 0.00 | 70.00 |
| | 7.07 | 1.28 | | | 10.00 | 20.00 | 70.00 | 0.00 |
| | 9.01 | 1.51 | | | 15.00 | 45.00 | 0.00 | 40.00 |
| | 5.95 | 1.02 | | | 50.00 | 0.00 | 45.00 | 5.00 |
| 4 | 15.12 | 3.01 | | | 5.00 | 5.00 | 5.00 | 85.00 |
| | 12.12 | 2.26 | | | 5.00 | 10.00 | 40.00 | 45.00 |
| | 10.02 | 1.79 | | | 5.00 | 25.00 | 40.00 | 30.00 |
| | 11.84 | 2.18 | | | 10.00 | 10.00 | 35.00 | 45.00 |
| | 7.43 | 1.35 | | | 10.00 | 15.00 | 75.00 | 0.00 |
| | 13.08 | 2.44 | | | 15.00 | 10.00 | 10.00 | 65.00 |
| | 7.22 | 1.29 | | | 15.00 | 20.00 | 60.00 | 5.00 |
| | 9.04 | 1.56 | | | 15.00 | 30.00 | 25.00 | 30.00 |
| | 6.81 | 1.16 | | | 15.00 | 40.00 | 30.00 | 15.00 |
| | 12.33 | 2.27 | | | 20.00 | 5.00 | 20.00 | 55.00 |
| | 5.86 | 1.04 | | | 25.00 | 20.00 | 55.00 | 0.00 |
| | 6.00 | 1.00 | | | 25.00 | 40.00 | 20.00 | 15.00 |
| | 6.18 | 1.02 | | | 25.00 | 45.00 | 10.00 | 20.00 |
| | 7.08 | 1.16 | | | 35.00 | 30.00 | 10.00 | 25.00 |
| | 6.68 | 1.08 | | | 40.00 | 30.00 | 5.00 | 25.00 |
| | 6.67 | 1.07 | | | 45.00 | 25.00 | 5.00 | 25.00 |
| | 6.99 | 1.12 | | | 60.00 | 5.00 | 10.00 | 25.00 |
| | 6.61 | 1.05 | | | 60.00 | 10.00 | 5.00 | 25.00 |
| | 6.60 | 1.05 | | | 65.00 | 5.00 | 5.00 | 25.00 |

TABLE 4

| k | Porosity % | SA m²/cc | | $D_L$ / $D_s$ / n | 840 / 0.2 / 1.0 % | 300 / 0.2 / 1.0 % | 74 / 0.2 / 0.4 % | 15 / 0.2 / 0.1 % |
|---|---|---|---|---|---|---|---|---|
| 1 | 6.30 | 2.01 | | | 0.00 | 0.00 | 100.00 | 0.00 |
| 2 | 7.26 | 3.22 | | | 0.00 | 0.00 | 70.00 | 30.00 |
| | 6.77 | 1.83 | | | 0.00 | 10.00 | 90.00 | 0.00 |
| | 8.90 | 3.68 | | | 0.00 | 40.00 | 0.00 | 60.00 |
| | 7.71 | 3.09 | | | 0.00 | 50.00 | 0.00 | 50.00 |
| | 19.31 | 1.32 | | | 0.00 | 80.00 | 0.00 | 20.00 |
| 3 | 8.96 | 3.93 | | | 0.00 | 5.00 | 45.00 | 50.00 |
| | 5.57 | 2.52 | | | 0.00 | 5.00 | 80.00 | 15.00 |
| | 8.83 | 3.84 | | | 0.00 | 10.00 | 40.00 | 50.00 |
| | 5.40 | 2.43 | | | 0.00 | 10.00 | 75.00 | 15.00 |

TABLE 4-continued

| k | Porosity % | SA $m^2/cc$ | | $D_L$ / $D_s$ / n | 840 / 0.2 / 1.0 % | 300 / 0.2 / 1.0 % | 74 / 0.2 / 0.4 % | 15 / 0.2 / 0.1 % |
|---|---|---|---|---|---|---|---|---|
| | 6.81 | 2.94 | | | 0.00 | 15.00 | 55.00 | 30.00 |
| | 6.65 | 2.85 | | | 0.00 | 20.00 | 50.00 | 30.00 |
| | 5.49 | 2.27 | | | 0.00 | 40.00 | 35.00 | 25.00 |
| | 12.42 | 1.50 | | | 0.00 | 60.00 | 25.00 | 15.00 |
| | 19.31 | 1.12 | | | 0.00 | 80.00 | 5.00 | 15.00 |
| | 8.96 | 3.93 | | | 5.00 | 0.00 | 45.00 | 50.00 |
| | 8.32 | 3.38 | | | 5.00 | 40.00 | 0.00 | 55.00 |
| | 17.36 | 1.61 | | | 5.00 | 70.00 | 0.00 | 25.00 |
| | 7.06 | 1.45 | | | 10.00 | 20.00 | 70.00 | 0.00 |
| | 19.62 | 1.02 | | | 10.00 | 75.00 | 0.00 | 15.00 |
| | 6.29 | 2.73 | | | 15.00 | 0.00 | 60.00 | 25.00 |
| | 19.14 | 1.02 | | | 15.00 | 70.00 | 0.00 | 15.00 |
| | 18.63 | 1.01 | | | 20.00 | 65.00 | 0.00 | 15.00 |
| | 9.46 | 3.95 | | | 25.00 | 10.00 | 0.00 | 65.00 |
| | 10.22 | 2.19 | | | 25.00 | 40.00 | 0.00 | 35.00 |
| | 6.02 | 1.33 | | | 30.00 | 5.00 | 65.00 | 0.00 |
| 4 | 6.96 | 3.03 | | | 5.00 | 5.00 | 60.00 | 30.00 |
| | 9.13 | 3.94 | | | 5.00 | 10.00 | 30.00 | 55.00 |
| | 5.86 | 2.37 | | | 5.00 | 40.00 | 25.00 | 30.00 |
| | 9.00 | 3.84 | | | 10.00 | 10.00 | 25.00 | 55.00 |
| | 7.69 | 2.18 | | | 10.00 | 45.00 | 15.00 | 30.00 |
| | 12.97 | 1.19 | | | 10.00 | 55.00 | 25.00 | 10.00 |
| | 7.19 | 2.95 | | | 15.00 | 20.00 | 25.00 | 40.00 |
| | 7.33 | 3.04 | | | 20.00 | 10.00 | 30.00 | 40.00 |
| | 3.96 | 1.74 | | | 20.00 | 15.00 | 55.00 | 10.00 |
| | 17.16 | 1.11 | | | 20.00 | 60.00 | 5.00 | 15.00 |
| | 3.78 | 1.65 | | | 25.00 | 15.00 | 50.00 | 10.00 |
| | 3.47 | 1.46 | | | 25.00 | 25.00 | 40.00 | 10.00 |
| | 5.32 | 2.15 | | | 30.00 | 15.00 | 30.00 | 25.00 |
| | 3.14 | 1.46 | | | 30.00 | 20.00 | 40.00 | 10.00 |
| | 3.22 | 1.35 | | | 40.00 | 15.00 | 35.00 | 10.00 |
| | 14.51 | 1.09 | | | 40.00 | 40.00 | 5.00 | 15.00 |
| | 18.07 | 1.06 | | | 75.00 | 5.00 | 5.00 | 15.00 |

TABLE 5

| k | Porosity % | SA $m^2/cc$ | | $D_L$ / $D_s$ / n | 840 / 0.2 / 0.7 % | 300 / 0.2 / 0.7 % | 74 / 0.2 / 0.2 % | 15 / 0.2 / 0.01 % |
|---|---|---|---|---|---|---|---|---|
| 1 | 7.51 | 3.28 | | | 0.00 | 0.00 | 100.00 | 0.00 |
| 2 | 9.22 | 3.97 | | | 0.00 | 0.00 | 80.00 | 20.00 |
| | 7.22 | 3.13 | | | 0.00 | 5.00 | 95.00 | 0.00 |
| | 6.93 | 2.99 | | | 0.00 | 10.00 | 90.00 | 0.00 |
| | 5.36 | 2.26 | | | 0.00 | 35.00 | 65.00 | 0.00 |
| | 5.02 | 2.12 | | | 0.00 | 40.00 | 60.00 | 0.00 |
| | 7.21 | 3.13 | | | 5.00 | 0.00 | 95.00 | 0.00 |
| | 6.91 | 2.97 | | | 10.00 | 0.00 | 90.00 | 0.00 |
| | 4.95 | 2.04 | | | 40.00 | 0.00 | 60.00 | 0.00 |
| | 13.77 | 1.17 | | | 85.00 | 0.00 | 0.00 | 15.00 |
| 3 | 7.99 | 3.37 | | | 0.00 | 15.00 | 70.00 | 15.00 |
| | 7.87 | 3.25 | | | 0.00 | 25.00 | 55.00 | 20.00 |
| | 8.02 | 3.28 | | | 0.00 | 30.00 | 45.00 | 25.00 |
| | 7.16 | 2.84 | | | 0.00 | 45.00 | 30.00 | 25.00 |
| | 5.67 | 2.40 | | | 5.00 | 25.00 | 70.00 | 0.00 |
| | 14.90 | 1.00 | | | 5.00 | 85.00 | 0.00 | 10.00 |
| | 6.30 | 2.68 | | | 10.00 | 10.00 | 80.00 | 0.00 |
| | 9.33 | 1.95 | | | 10.00 | 65.00 | 0.00 | 25.00 |
| | 6.87 | 2.58 | | | 15.00 | 50.00 | 0.00 | 35.00 |
| | 3.54 | 1.35 | | | 20.00 | 45.00 | 35.00 | 0.00 |
| | 7.83 | 3.20 | | | 25.00 | 0.00 | 55.00 | 20.00 |
| | 8.32 | 3.20 | | | 25.00 | 30.00 | 0.00 | 45.00 |
| | 3.28 | 1.35 | | | 25.00 | 40.00 | 35.00 | 0.00 |
| 4 | 7.70 | 3.21 | | | 5.00 | 15.00 | 65.00 | 15.00 |
| | 5.71 | 2.31 | | | 5.00 | 40.00 | 45.00 | 10.00 |
| | 7.31 | 2.86 | | | 5.00 | 45.00 | 20.00 | 30.00 |
| | 9.80 | 1.27 | | | 5.00 | 70.00 | 20.00 | 5.00 |
| | 6.94 | 2.88 | | | 10.00 | 15.00 | 65.00 | 10.00 |
| | 6.16 | 2.56 | | | 10.00 | 20.00 | 65.00 | 5.00 |
| | 13.04 | 1.14 | | | 10.00 | 75.00 | 5.00 | 10.00 |
| | 6.84 | 2.67 | | | 15.00 | 35.00 | 25.00 | 25.00 |
| | 5.40 | 2.06 | | | 15.00 | 50.00 | 15.00 | 20.00 |
| | 9.51 | 3.91 | | | 20.00 | 5.00 | 35.00 | 40.00 |
| | 3.79 | 1.53 | | | 20.00 | 45.00 | 30.00 | 5.00 |
| | 12.27 | 1.12 | | | 20.00 | 65.00 | 5.00 | 10.00 |
| | 7.57 | 2.97 | | | 25.00 | 20.00 | 25.00 | 30.00 |

TABLE 5-continued

| k | Porosity % | SA $m^2/cc$ | | $D_L$ / $D_s$ / n | 840 / 0.2 / 0.7 % | 300 / 0.2 / 0.7 % | 74 / 0.2 / 0.2 % | 15 / 0.2 / 0.01 % |
|---|---|---|---|---|---|---|---|---|
| | 4.83 | 1.95 | | | 25.00 | 25.00 | 45.00 | 5.00 |
| | 5.48 | 2.24 | | | 30.00 | 10.00 | 55.00 | 5.00 |
| | 7.88 | 3.02 | | | 30.00 | 25.00 | 5.00 | 40.00 |
| | 4.11 | 1.64 | | | 40.00 | 20.00 | 35.00 | 5.00 |
| | 4.63 | 1.79 | | | 50.00 | 10.00 | 30.00 | 10.00 |
| | 8.16 | 1.17 | | | 70.00 | 10.00 | 10.00 | 10.00 |

In the slurry of this invention, no more than 0.5 weight percent of the solid carbonaceous particles in the slurry have a particle size less than 0.05 microns. It is preferred that at least 85 weight percent of the coal particles in the slurry have a particle size less than 300 microns. It is more preferred that at least 90 weight percent of the coal particles in the slurry have a particle size less than 300 microns. In the most preferred embodiment, at least 95 weight percent of the coal particles in the slurry have a particle size less than 300 microns.

In the preferred embodiment, the fluid is water and colloidal sized carbonaceous particles in the slurry have a net zeta potential of from about 15 to about 85 millivolts. The following discussion of zeta potential will refer to a coal-water slurry, it being understood that the discussion is equally applicable to, e.g., coke-water slurries, graphite-water slurries, etc.

It is preferred that the colloidal sized particles coal in the coal-water slurry have a net zeta potential of of from about 15 to about 85 millivolts. As used herein, the term "zeta potential" refers to the net potential, be it positive or negative in charge; thus, a zeta potential of from about 15.4 to 70.2 millivolts includes zeta potentials of from about −15.4 to about −70.2 millivolts as well as zeta potentials of from about +15.4 to about +70.2 millivolts. In a more preferred embodiment, said zeta potential is from about 30 to 70 millivolts.

As used in this specification, the term "zeta potential" has the meaning given it in the field of colloid chemestry. Concise discussions and descriptions of the zeta potential and methods for its measurement are found in many sources including, T. M. Riddick, U.S. Pat. No. 3,454,487, issued July, 1969; Douglas et al., U.S. Pat. No. 3,976,582 issued Aug. 24, 1976; *Encyclopedia of Chemistry*, 2nd edition, Clark et al., Reinhold Publ. Corp. 1966, pages 263–265; *Chemical and Process Technology Encyclopedia*, D. M. Considine, editor-in-chief, McGraw-Hill Book Company, N.Y., pages 308–309; *Chemical Technology: An Encyclopedic Treatment*, supra, Vol. VII, pages 27–32; Kirk-Othmer, *Encyclopedia of Chemical Technology*, 2nd Edition, Vol. 22, pages 90–97; and T. M. Riddick, *Control of Colloid Stability Through Zeta Potential*, Zeta-Meter, Inc. New York City. The disclosures of the aforementioned documents are hereby incorporated into this specification by reference.

"Zeta potential" may be measured by conventional techniques and apparatus of electroosmosis such as those described, e.g., in Potter, "Electro Chemistry"; Cleaver-Hume Press, Ltd.; London (1961). Zeta potential can also be determined by measuring electrophoretic mobility (EPM) in any of several commercial apparatuses. In the present invention, a Pen Kem System 3000 (made by Pen Kem Co. Inc. of Bedford Hills, N.Y.) was used for determining zeta potential in the examples herein. This instrument is capable of automatically taking samples of coal particles and producing an EPM distribution of Fast Fourier Transform Analysis from which the average zeta potential can be calculated in millivolts.

The zeta potential is measured using very dilute samples of the $<10$ μm sized coal particles in the coal compact of the coal-water slurry.

It is preferred that the zeta potential of the colloidal sized coal particles in the coal consist of the slurry of this invention be negative in charge and be from about $-15.4$ to about $-70.2$ millivolts. It is more preferred that said zeta potential be from about $-30$ to about $-70$ millivolts.

In one embodiment, it is preferred that the zeta potential of said colloidally sized coal particles be "near maximum". "Near maximum zeta potential", as used in this specification, means a value of zeta potential, measured at constant electrical conductivity, below the maximum zeta potential as defined and discussed in the references cited in the portion of this specification wherein the term "zeta potential" is defined. It is sometimes necessary to normalize the zeta potential values with respect to the electrical conductivity of the carrier fluid because zeta potential is limited by the electrical conductivity of the carrier fluid. The near maximum zeta potential should be of a millivoltage sufficient to provide the coal particles with a repulsive charge great enough to disperse the coal particles in the coal-water slurry. In this embodiment, it is preferred that the zeta potential on the colloidal coal particles be from about 20 to about 95 percent of the maximum zeta potential. It is more preferred that the zeta potential on the colloidal coal particles be from about 40 to about 80 percent of the maximum zeta potential for this embodiment.

The maximum zeta potential may be determined by measuring the Brookfield viscosity of the slurry at different zeta potentials. For a given system, maximum zeta potential has been reached when further increases in the surfactant concentration in the slurry do not further decrease the Brookfield viscosity of the system at 100 rpm.

One preferred means for measuring the zeta potential is to grind a sample of coal in either a laboratory size porcelain ball mill with porcelain balls in distilled water at 30 weight percent solids for approximately 24 hours or in a steel ball mill with steel balls at 30 weight percent solids for 16 hours or until all of the particles in the coal are less than 10 microns in size. Small samples of this larger sample can then be prepared in a known way by placing them in a vessel equipped with a stirrer with a sample of water to be used as a carrier in the coal-water slurry. Various acidic and basic salts are then added in incremental amounts to vary the pH, and various concentrations of various candidate dispersing agent organic surfactants likewise are added in incremental amounts (e.g., grams per gram coal, both dry basis), alone or in combinations of two or more. These samples are then evaluated in any electrophoretic mobility, electroosmosis, or streaming potential apparatus to determine electrical data, from which the zeta potential is calculated in a known way. Plots of zeta potential, pH, and specific conductance vs concentration may then be made to indicate candidate surfactants, or combinations thereof to be used to produce the optimum dispersion of coal particles in the carrier water below the amount of which dilatency may be reached.

The process of this invention allows one to produce stable slurries with a wide variety of different coals. Some coals, with suitable high Hardgrove Grindability Indices and Free Swelling Indices can be easily ground to produce the slurry of this invention. However, other coals with relatively low Hardgrove Grindability Indices and Free Swelling Indices, are very difficult to grind with conventional grinding technology to produce the slurry of this invention. In the Hardgrove method of determining grindability, a prepared sample receives a definite amount of grinding energy in a miniature ball-ring pulverizer. The unknown sample is compared with a coal chosen as having 100 grindability. The Hardgrove grindability index $=13+6.93$ W, where W is the weight of material passing the number 200 sieve (see A.S.T.M. Designation D-409-71, the disclosure of which is hereby incorporated by reference into this specification. The Free Swelling Index measures the tendency of a coal to swell when burned or gasified in a fixed or fluidized bed. Details of the test are given in ASTM Standards on Coal and Coke and in U.S. Bureau of Mines Dept. Investigation 3989, the disclosure of which is hereby incorporated by reference into this specification.

Table 6 illustrates typical approximate properties of some coals, such as their Hardgrove Grindability Indices, their Free Swelling Indices, and the maximum solids concentrations at which these coals typically can be ground in a single pass through a tumbling mill with a dispersant selected in accordance with procedure described above to minimize slurry viscosity.

TABLE 6

| Coal | Hardgrove Grindability Index of Coal | Free Swelling Index of Coal | Maximum Solids Contents at Which Coal in a Coal-Water Slurry Can Be Ground (Volume Percent) |
|---|---|---|---|
| Upper Freeport (low volatiles) | 87 | 9.0 | 73 |
| Upper Freeport (medium volatiles) | 78 | 7.0 | 73 |
| Moss #1 | 70 | 8.0 | 73 |
| Dorothy | 46 | 7.5 | 70 |
| Pittsburgh | 60 | 7.0 | 70 |
| Ohio #6 | 50 | 3.5 | 69 |
| Wambo (Australia) | 50 | 1.5 | 68 |

Coals such as the Upper Freeport (both low and high volatiles) and the Moss #1 can generally be wet ground in a single pass through a tumbling mill to produce a slurry with suitable stability. However, coals such as the Dorothy, the Pittsburgh, the Ohio #6, and the Wambo—all of which have relatively low Hardgrove Grindability Indices and Free Swelling Indices—generally cannot be easily wet ground in a single pass through a tumbling mill to produce a slurry with suitable stability.

The grinding process of this invention allows one to produce slurries with excellent stability properties with coals which have both relatively high and relatively low Hardgrove Grindability Indices and Free Swelling Indices. In this grinding process, a coal-liquid mixture is preferably ground at high solids content in the presence of a dispersing agent until (1) said mixture comprises a compact of finely-divided particles of coal dispersed in said liquid which has a specified specific surface area and porosity properties, (2) the slurry has specified solids content, viscosity, and yield stress properties, (3)

the particle size distribution in the slurry is in accordance with a specified CPFT formula, and (4) the solids content, the porosity, the specific surface area, and the zeta potential property of the slurry are related in accordance with a specified stability formula. In some cases, the aforementioned slurry properties will not be in accordance with the stability formula and/or the particle size distribution will not be in accordance with the CPFT formula. In these cases, the stability of the slurry can be increased by either (1) adding fines to the slurry in order to increase the specific surface area, and/or (2) adding surfactant to the slurry to affect the zeta potential, and/or (3) adding stabilizer to the slurry to affect the zeta potential, and/or (4) diluting or concentrating the slurry. In the stability equation, the sum of solids content, surface area, and a zeta potential term must be within a certain range; thus, any one or all of steps (1), (2), (3), and (4) might effect stability.

The stabilized slurry of this invention is produced by a novel process comprising the steps of: (1) grinding a solid carbonaceous material at a solid content of at least 60 volume percent until it contains at least, about 5 weight percent of colloidal size carbonaceous particles to produce a ground consist; and (2) mixing said ground consist with from 0.01 to about 4.0 weight percent of dispersing agent and up to about 40 volume percent of liquid until (a) the slurry viscosity, solids content, and yield stress properties are as described hereinabove, (b) the slurry consist particle size, surface area, and porosity properties are as described above, and (c) the slurry properties are in accordance with the stability equation. The term "... grinding at a solids content of at least 60 volume percent" includes, e.g., dry grinding as well as wet grinding. The mixing and grinding steps can be done simultaneously (in the case of one-stage grinding) or sequentially (where, e.g., one or both of two separate carbonaceous fractions are separately ground wet or dry with or without surfactant and then they are mixed together with each other and with liquid and, optionally, reground).

The stability formula of this invention is:

$$V_s + P_s + SA + \frac{240}{ZP} = H$$

wherein:

$V_s$ is the porosity of the carbonaceous consist of the slurry, in percent;

P is the percent of the carbonaceous solids in the slurry, in volume percent;

SA is the specific surface area of the consist of the slurry, in square meters per cubic centimeter;

ZP is the net zeta potential of the colloidal sized particles in the consist of the slurry, in millivolts; and H is a coefficient varying from 75–98.

In the process of this invention, from about 60 to about 80 percent (by volume) of at least one carbonaceous solid is mixed with carrier liquid and surfactant. The terms "mixed" and "mixing", as used in this specification, refers to the steps of combining or blending several masses into one mass and includes, e.g., blending, grinding, milling, and all other steps by which two or more masses are brought into contact with each other and combined to some extent. Conventional means for mixing viscous materials can be used in the process of this invention. Thus, by way of illustration and not limitation, one can used batch mixers such as change-can mixers, stationary tank mixers, gate mixers, shear-bar mixers, helical blade mixers, double-arm kneading mixers, screw-discharge batch mixers, intensive mixers, roll mills, bulk blenders, Littleford-Lodige mixers, cone and screw mixers, pan muller mixers, and the like; one can use continuous mixers such as single-screw extruders, the Rietz extrudor, the Baker Perkins Ko-Kneader, the Transfer-Mix, the Baker Perkins Rotofeed, twin-screw continuous mixers, trough and screw mixers, pug mills, the Kneadermaster, and the like; one can use tumbling mills such as, e.g., ball mills, pebble mills, rod mills, tube mills, compartment mills, and the like; and one can use non-rotary ball or bead mills such as stirred mills (including the Sweco dispersion mill, the Attritor, the Bureau of Mines mill described in U.S. Pat. No. 3,075,710 vibratory mills such as the Vibro-Energy mill, the Podmore-Boulton mill, the Vibratom, and the like. The various processes and apparatuses which can be used to mix the carbonaceous solid with the carrier liquid and dispersant are well known to those skilled in the art and are described in, e.g., Perry and Chilton's *Chemical Engineers' Handbook*, Fifth Edition (McGraw Hill, New York, 1973), pages 19–14 to 19–26 (Paste and viscous-material mixing), and 8–16 to 8–44 (crushing and grinding equipment). The disclosure of the aforementioned portions of the *Chemical Engineers' Handbook* is hereby incorporated by reference into this specification.

When the liquid mixed with the carbonaceous solid is water or is comprised of from about 5 to about 99 weight percent of water, it is preferred that the temperature of the solids-liquid mixture be maintained at from ambient to about 99 degrees centigrade to insure that the water does not substantially vaporize; thus, if need be, said mixture can be cooled by conventional means during the mixing step.

From about 60 to 80 volume percent of at least one carbonaceous solid is mixed with liquid and dispersing agent in the process of this invention. It is preferred to use from about 63 to about 77 volume percent of at least one solid carbonaceous material in said process, and it is more preferred to use from about 66 to about 73 volume percent of said solid material.

The carbonaceous solid can be comprised of one or more fractions of carbonaceous material. Thus, with reference to coal, e.g., the carbonaceous solid used in the process of this invention can be (1) one coal consist, or (2) a blend of several different coal consists. As used herein and in the prior art, the term "consist" means the particle size distribution of the solid phase of the coal-water slurry. For example, the term "8 mesh×0" indicates coal with a graded size, or consist, of coal particles distributed in the range of 8 mesh and zero (dust). Thus, the term "about 1180 microns×0.05 microns" indicates coal with a graded size, or consist, in the range of from about 1180 microns to about 0.05 microns.

In one embodiment of the process of this invention a single consist of carbonaceous material is mixed with carrier liquid and dispersins agent. In this embodiment, from about 60 to about 80 volume percent of said single consist of carbonaceous material is mixed (such as, e.g., by grinding) with from about 0.01 to about 4.0 weight percent of dispersing agent (based upon the weight of the dry carbonaceous material) and the carrier liquid until a slurry with the properties described above is obtained. In this embodiment, it is preferred that the mixing method used be grinding and that the solids-liquid mixture be ground in either a tumbling mill and/or a non-rotary ball or bead mill selected from the group consisting of ball mills and stirred ball mills. When a ball mill is used to grind the mixture, it is preferred that the ball mill be run at a reduced speed. In this embodiment, the mixture is ground at said high solids content of from about 66 to about 77 volume percent of coal and at a ball mill speed of from about 50 to about 70 percent of the ball mill critical speed. The critical speed of the ball mill is the theoretical speed at which the centrifugal force on a ball in contact with the mill shell at the height of its path equals the force on it due to gravity, and it is defined by the equation $$N_c = \frac{76.6}{D}$$

wherein $N_c$ is the critical speed (in rpm), and D is the diameter of the mill (feet) for a ball diameter that is small with respect to the mill diameter. A description of tumbling mills, such as ball mills, appears on pages 8–25 to 8–29 of the Fifth Edition of the *Chemical Engineers' Handbook* (edited by Perry and Chilton, McGraw Hill, New York 1973).

In another embodiment of the process of this invention, at least two consists of carbonaceous material are mixed with carrier liquid. Both of said consists of carbonaceous material can be produced by wet grinding; thus, e.g., one of the consists can be produced by grinding coal at a high solids content (60–80 volume percent) in the presence of water and surfactant, the second of the consists can be produced by grinding coal at a lower solids content (30–60 volume percent) in a ball mill or a stirred ball mill, and the first and the second coal consists can be ground together with each other (and, optionally, with one or more addititonal consists produced by wet and/or dry grinding) at a solids content of from about 60 to about 80 volume percent in the presence of from about 0.01 to about 4.0 weight percent of dispersant and water to produce one of the stable slurries of this invention. Both of said consists of carbonaceous material can be produced by dry grinding; thus, e.g., one of the consists can be prepared by grinding one pulverized coal (i.e., coal which has been milled or ground to a consist of about 40 mesh by 0) in, e.g., a ring roller mill, a second or more of the consists can be prepared by dry grinding a second pulverized coal in, e.g., a micronizer fluid energy (jet) mill, and the two ground dry fractions are then blended in a blending tank at a solids concentration of from 60–90 volume percent with water and 0.01 to 4.0 weight percent of dispersant at a high shear stress in a mixer such as Greerco in-line mixer. At least one of said consists can be produced by wet grinding and at least one of said consists can be produced by dry grinding; thus, e.g., one of the consists can be produced by wet grinding coal at a low solids content (30–60 volume percent) in the presence of water and dispersant, a second of the consists can be Produced by dry grinding pulverized coal in either a micronizer fluid energy (jet) mill, or a ring roller mill, and the consists produced by wet and dry grinding are then blended in a blending tank at a solids concentration of 60–80 volume percent with water and 0.01 to 4.0 weight percent of dispersant at a high shear stress in a mixer such as a Greerco in-line mixer. It will be apparent to those skilled in the art there are many other arrangements wherein two consists of carbonaceous material are mixed with carrier liquid to produce the slurry of this invention; they are intended to be within the scope of the invention.

In yet another embodiment of the process of this invention a single consist of carbonaceous material produced by dry grinding is mixed with carrier liquid and dispersant. Thus, e.g., coke can be dry ground in a ball mill, and the ground coke can be mixed in a high shear blender (such as, e.g., a Greerco in-line mixer) at a solids content of 60–80 volume percent with liquid and 0.01 to 4.0 weight percent of dispersant.

The carbonaceous solid is mixed with from about 0.01 to about 4.0 weight percent (based upon dry weight of carbonaceous solid) of dispersing agent. In the case where one consist of carbonaceous solid is mixed with the liquid, (1) all of the dispersant can be added to the liquid, the consist can be dry ground, and the dry ground consist can be added to the liquid-dispersant mixture, (2) a portion of the dispersant can be added to the liquid, and the ground consist portion and the liquid-dispersant portion can be combined, (3) the consist can be wet ground with part of all of the dispersant and liquid and then, if necessary, combined with the remainder of the liquid and/or dispersant.

In the case where at least two consists of carbonaceous solid material are mixed with liquid, (1) both of the consists can be dry ground and mixed with liquid and dispersant, (2) the dispersant can be mixed with the liquid, and the dry ground consists can be mixed with the liquid-dispersant mixture; (3) one of the consists can be dry ground, a second of the consists can be wet ground with part or all of the dispersant, and the ground consists can be mixed with the balance of the liquid and dispersant which was not theretofore mixed with the consists, or (4) some or all of the dispersant can be wet ground with one or both of the consists, and the ground consists can then be mixed with the liquid and the balance of the dispersant which was not theretofore mixed with the consists; (5) one or more consist can be wet ground with no dispersant and insufficient total water and then blended with dispersant and the balance of the water and/or other consist blends.

In the process of this invention, the carbonaceous solid material is mixed with dispersant and no more than about 40 volume percent of liquid. It is preferred to mix the solid with no more than about 30 volume percent of said liquid. It is even more preferred to mix the solid with no more than 25 volume percent of said liquid.

Several typical means of practicing the process of applicant's invention are illustrated in FIG. 1. In a wet grinding method, coal is charged to crusher 10. Any of the crushers known to those skilled in the art to be useful for crushing coal can be used as crusher 10. Thus, by way of illustration and not limitation, one can use, e.g., a rod mill, a gyratory crusher, a roll crusher, a jaw crusher, a cage mill, and the like. Generally, the coal is crushed to a size of about ¼″×0, although coarser and finer fractions can be used.

The crushed coal is fed through line 12 to mill 14. Mill 14 can be either a tumbling mill (such as a ball mill, pebble mill, rod mill, tube mill, or compartment mill) or a non-rotary ball or bead mill. Liquid (such as water) and diluted dispersing agent are fed through lines 16 and 18, respectively, to mill 14.

The mill 14 will have sufficient coal and liquid fed to it so that it will contain from about 60 to about 80 volume percent of coal. Generally, one should charge from about 0 to about 10 volume percent more coal to mill 14 than he desires in the final slurry product, subject to the qualification that in no event should more than 80 volume percent of coal be charged to the mill.

In general, less than about 40 volume percent of liquid and from about 0.01 to about 4.0 weight percent of dispersant (based on weight of dry coal) will be fed in lines 16 and 18, respectively, to mill 14.

When mill 14 is a ball mill, it is preferred to run it at less than about 70 percent of its critical speed. It is more preferred to run ball mill 14 at about 60 percent of its critical speed. It is more preferred to run ball mill 14 at less than about 55 percent of its critical speed. In one of the most preferred embodiments, ball mill 14 is run at less than about 52 percent of its critical speed.

Ground slurry from mill 14 is passed through line 20 through sieve 22. Sieve 22 may be 40 mesh sieve which allows underflow slurry of sufficient fineness (less than 420 microns) through to line 24; overflow particles which are greater than 420 microns are recycled via line 26 back into mill 14 wherein they are subjected to further grinding.

A portion of the underflow slurry from line 24 flows through line 28, viscometer 30, density meter 32, and particle size distribution analyzer 34; the remaining portion of the underflow slurry flows through line 36.

Any of the viscometers known to those skilled in the art can be used as viscometer 30. Thus, by way of illustration, one can use a Nametre Viscometer. The viscometer 30 indicates the viscosity of the ground slurry. If the viscosity of the ground slurry is higher than desired, then either mill 14 is not grinding the coal to produce a sufficiently high surface area, and low porosity, and/or the amount or type of dispersing agent used is insufficient to produce a sufficiently high zeta potential on the colloidal coal particles; and the underflow slurry should be subjected to further tests (in density meter 32 and particle size distribution analyzer 34).

Any of the density meters known to those skilled in the art can be used as density meter 32. Density meter 32 indicates the density of the underflow slurry, which directly varies with its solids content. If the density of the underflow slurry is lower or higher than desired, then it is possible that the particle size distribution of the coal compact in the underflow slurry is lower or higher than desired. In this case, the underflow slurry should be subjected to further tests in particle size analyzer 34 to determine what the particle size distribution of the underflow slurry is and its attendant surface area and porosity.

Particle size distribution analyzer 34 analyzes the particle size distribution of the compact of the underflow slurry. Any of the particle size distribution analyzers known to those skilled in the art, such as, e.g., Micromeritics Sedigraph 5500L, Coulter Counter, Leeds and Northrup Microtrac Particle Analyzers, can be used as analyzer 34. From the data generated by analyzer 34 the specific surface area and the porosity of the compact of underflow slurry can be determined.

If the solids content, the viscosity, the specific surface area, and the porosity properties of the underflow slurry are as desired, then the underflow slurry is passed through line 38 to final trim tank 40. If, however, either the solids content, the viscosity, the specific surface area, or the porosity property of the underflow slurry is not as desired, then a portion of underflow slurry is passed through line 36 to mill 42. Depending on how badly the underflow slurry is out of specification, from about 1 to about 30 volume percent of the underflow slurry is passed to mill 42 and the remainder is passed to trim tank 40. Recycling the slurry to mill 42 and, after regrinding, to mill 14, increases the quality of the slurry coming out of mill 14.

Mill 42 can be either a tumbling mill (such as a ball mill) or a non-rotary ball or bead mill (such as a stirred ball mill). When mill 42 is a ball mill, it is preferred to run it at less than about 70 percent of its critical speed and, more preferably, at less than about 60 percent of its critical speed; in the most preferred embodiment, when mill 42 is a ball mill it is run at less than about 55 percent of its critical speed.

Water is fed into mill 42 through line 44 so that the solids concentration of the ground slurry fed through line 36 will be adjusted to about 30 to about 60 volume percent. The diluted slurry in mill 42 is then ground in mill 42 until at least about 95 volume percent of the particles in the slurry have diameters less than about 20 microns. It is preferred to grind the slurry in mill 42 until at least 95 volume percent of the particles in the slurry are smaller than 15 microns and, more preferably, 10 microns. In the most preferred embodiment, the diluted slurry in mill 42 is ground until at least about 95 volume percent of the particles in the slurry have diameters less than about 5 microns.

The slurry ground in mill 42 is then passed through line 46 to high shear mixer 48. Any of the high-shear, high-intensity mixers known to those skilled in the art can be used as mixer 48; thus, e.g., the mixers described on page 19-7 of Perry and Chilton's *Chemical Engineer's Handbook*, Fifth Edition, supra, can be used.

Dispersing agent is passed through line 50 to high shear mixer 48 in order to optimize the zeta potential of the colloidal particles in the slurry. For a given coal, dispersant, and solids content a given amount of dispersant will optimize zeta potential, and this amount can be determined in accordance with the screening tests described in this specification. From about 70 to about 110 percent of the amount of dispersant required to obtain the maximum zeta potential should be charged through line 50 to mixer 48.

In general, the ground slurry is mixed with water and dispersant in mixer 48 for from about 3 to about 15 minutes and, preferably, for about 10 minutes. The mixture from mixer 48 to then passed through line 52 and through viscometer 54, density meter 56, and particle size distribution analyzer 48. If the properties of the mixed slurry from mixer 48 are not suitable, then the water flow to mill 42 through line 44 and/or the slurry flow to mill 42 through line 36 and/or the dispersant flow to mixer 48 through line 50 are adjusted until the properties are suitable. If the properties of the mixed slurry from mixer 48 are suitable, then the mixed slurry is recycled to trim tank 40 or to mill 14 through line 60 where it is mixed with and ground with crushed coal from line 12, water from line 16, and dispersant from line 18.

FIG. 1 also illustrates a dry grinding process for making the stabilized slurry of this invention. In this alternative process, crushed solid material, such as coke, from crusher 10 is passed through line 62 to dry grind 64, where it is dry ground. Any dry grinder known to those skilled in the art can be used. Thus, by way of example, one can use ball mills or the ring roller mills described on pages 8-33 and 8-34 of Perry and Chilton's *Chemical Engineer's Handbook*, Fifth Edition, supra. The crushed material is ground in grinder 64 until it is pulverized, that is until it is a consist of about 40 mesh×0.

The ground carbonaceous material from dry grinder 64 is passed through line 66 to trim tank 40. Water and dispersing agent are passed through lines 68 and 70, respectively, to trim tank 40. The cabonaceous material/water/dispersant mixture is stirred by stirrer 72, and the stirred mixture is passed through line 74 to high shear mixer 76. Any of the high-shear mixers described above can be used as mixer 76. The quality of the slurry produced in mixer 76 is evaluated by passing it through line 78 to zeta potential analyzer 80, particle size distribution analyzer 82, Haake viscometer 84, (for measuring yield stress), and density meter 86. If the net zeta potential of the colloidal particles in the slurry is from about 10 to about 90 millivolts, the solids content is from about 60 to 80 volume percent, the yield stress is from about 3 to about 18 Pascals, the surface area is form about 0.8 to about 4 $m^2/cc$, the porosity is less than 20 volume percent, and the compact in the slurry is described by the aforementioned equations, then the slurry produced by the dry grinding is satisfactory. However, if the slurry is not up to specifications, then a portion of the ground coal from line 66 is passed through line 86 to be dry ground in a micronizer fluid energy (jet) mill. The fine particles from jet mill 88 are passed through line 90 to trim tank 40 where they are mixed with the ground coal from line 66, the water from line 68, and the dispersant from line 70. Thereafter, the slurry produced in trim tank 40 is again evaluated in zeta potential analyzer 80, particle size distribution analyzer 82, Haake viscometer 84, and density meter 85 to determine whether the slurry is up to specifications. The process can be fine-tuned by this method until the properties of the slurry are as required; alternatively or additionally, one can alter the rate of flow of water and surfactant through lines 68 and 70, respectively, the rate of flow of coal from line 66 (by varying the speed of the mill and/or the rate at which crushed coal is fed to the mill through line 62), and the like. Alternatively, ground coal from dry grinders can be fed directly back to mills 14 or 42 and as feed for the wet grinding circuits.

In yet another method illustrated in FIG. 1, the amount of very finely ground slurry material in trim tank 40 can be increased by passing a portion of the mixed slurry from high speed mixer 48 through line 92 into trim tank 40. Alternatively, or additionally, the amount of moderately finely ground slurry material in trim tank 40 can be increased by passing a portion of the ground slurry from ball mill 14 through line 38 to slurry tank 40. This scheme allows various fractions of slurries from wet grinders 14 and 42 to be blended with various fractions of dry consist from dry grinders 64 and 88.

In practice of the invention, it is preferred that addition of any electrolytes and/or surfactants or other dispersing agents be carried out as grinding mill additives during preparation of the coal compact.

The agents maintain a low slurry viscosity during grinding. Furthermore, the agents are immediately available for adsorption on the new surfaces generated during comminution of the coal. Accordingly, need for later treatment with chemical ion species on the surfaces is minimized or eliminated, thereby saving time, energy, and materials cost.

In one aspect of this invention, a coal-water slurry comprised of from about 60 to about 80 volume percent of solids is ground until a slurry comprised of at least 5 weight percent of colloidal coal (by weight of slurry) is produced. Applicant has discovered that, when this grinding step is either preceded or followed by a cleaning step, a deashed coal which is cleaner and/or less viscous for any given coal and coal concentration is produced. The fact that a less viscous product is produced is unexpected for one might expect that a coal with more colloidal particles (and hence more surface area) should be more viscous than a coal without as many colloidal coal particles.

In one embodiment of this invention, a coal-water slurry comprised of from about 60 to about 80 volume percent of coal, from about 20 to about 40 volume percent of carrier water, and from about 0.01 to about 2.4 weight percent of dispersing agent is ground until at least about 5 weight percent of colloidal coal particles are present; generally, in order to obtain the correct concentration of the colloidal coal fraction, one must grind the slurry until at least about 95 weight percent of the coal in the mixture has a particle size of less than 300 microns.

The slurry may be ground in a one-stage grinding operation until the particle size distribution of the coal compact in the slurry is in substantial accordance with the aforementioned CPFT formula. Alternatively, one may grind a first coal-water slurry until, e.g., it is comprised of at least 10 weight percent of colloidal coal particles and thereafter blend in one or more additional fractions of either coal and/or coal-water slurries in amounts sufficient to produce a coal compact in slurry which is in substantial accordance with the CPFT formula. In yet another embodiment, one or more additional fractions of coal-water slurry and/or coal are added to the finely ground coal-water slurry, and the mixture is then ground at a solids content of from about 60 to about 80 volume percent solids until a coal compact in substantial accordance with said formula is produced. In any event, regardless of whether one only blends the additional fractions with the finely ground coal-water slurry or blends said fractions with the finely ground coal-water slurry and then again grinds the resulting mixture, sufficient water and dispersing agent should preferably be added to the mixture, if required, to bring its final concentration to a solids content of 60 to 80 volume percent, a water content of 20 to 40 volume percent and a dispersing agent content of from about 0.05 to about 4.0 percent. These components are preferably added, if needed, before the final blending and/or grinding step.

In the consist used in the slurry of this invention, the value of n is dependent on the sizes of $D_L$ and $D_s$. The size of $D_L$ for a particular coal is a fully controllable function of the grinding operation. It can be controlled by grinding coal until a desired size of $D_L$ is obtained. The size of $D_s$ is a less controllable function. It is dependent on the grindability of a particular coal, and will usually be the same $D_s$ size for that coal ground at the same solids content in the same mill.

In one of the preferred embodiments of this invention, the liquid in the solids liquid slurry of this invention is water, the dispersant(s) in said slurry is one or more anionic surfactants, and the pH of the slurry is from about 5 to about 12. In a more preferred embodiment, the solid carbonaceous material in said slurry is coal and the pH of said slurry is from about 7 to about 11. In an even more preferred embodiment, said coal-water slurry contains less than about 5 weight percent of ash. The term "ash", as used in this specification, includes non-carbonaceous impurities such as, e.g., inorganic sulphur, various metal sulphides, and other metal impurities as well as soil and clay particles. The fraction of ash in the coal can be calculated by dividing the weight of all of the non-carbonaceous material in the coal by the total weight of the coal.

The deashed coal-water slurry of this invention can be prepared by several methods. In one prefered embodiment coal may be obtained which has been efficiently deashed by any conventional cleaning method such as by heavy media cyclone, Batac jig, froth flotation, or any method known to those skilled in the art. In this case the coal may be be fed to crusher 10 in FIG. 1 if necessary, or bypass this crusher 10 if already less than ¼×0 and fed directly to mills 14 or 42 as may be desired.

Figure 4:
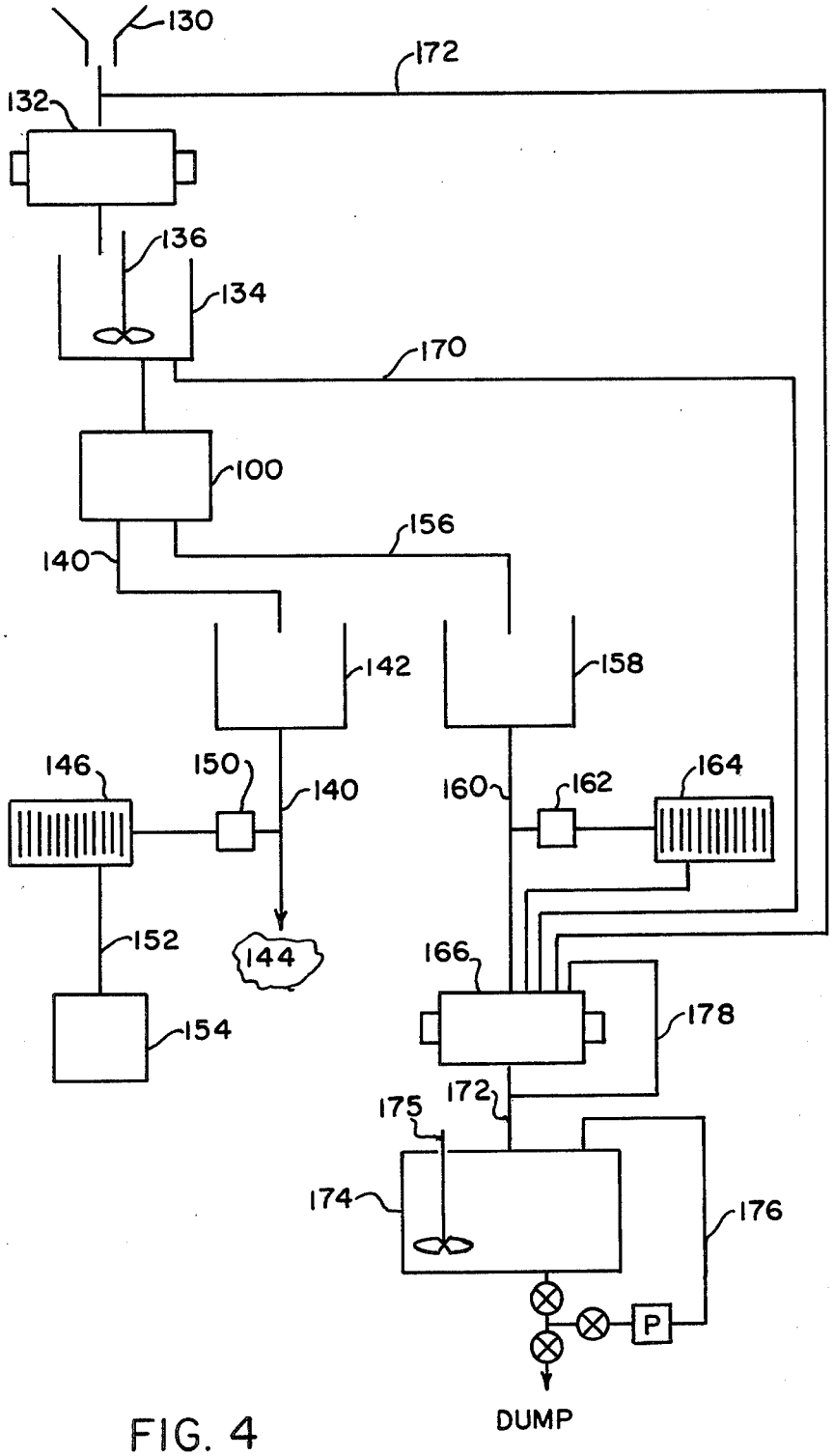
FIG. 4 is a flow diagram of a coal cleaning process described in this specification.

In another preferred embodiment the "as mined", or partially deashed coal may be fed directly to crusher 130 in FIG. 4, which illustrates one means of cleaning coal. In this process, any of the crushers known to those skilled in the art to be useful for crushing coal can be used. Thus, by way of illustration and not limitation, one can use, e.g., a rod mill, a gyratory crusher, a roll crusher, a jaw crusher, a cage mill, and the like. The coal is crushed in crusher 130 to a feed size appropriate to the size and type of the fine grinding mill used in the process.

The crushed coal from crusher 130 is then mixed with sufficient carrier water and ionic surfactant to produce a coal-water mixture containing from about 60 to about 85 weight percent of solids and from about 0.01 to about 2.4 weight percent based upon dry weight of coal, or surfactant and is fed to a mill 132 preferably a ball mill; in an alternative embodiment, the crushed coal, the surfactant, and the water are added separately to the mill 132 and mixed therein. In one embodiment, it is preferred to add a sufficient amount of organic or inorganic ionic surfactant so that the zeta potential of the ash particles in the coal-water slurry is from −15 to +15 millivolts and the zeta potential of the colloidal size coal particles in the coal-water slurry is from about −100 to −15 millivolts or +15 to +100 millivolts. The crushed coal, the water, and the ionic surfactant are milled until a coal consist no greater than about 20×0 mesh is produced.

The milled coal-water-surfactant mixture is then passed to zeta potential control tank 134 which contains stirrer 136. A sufficient amount of carrier water is added to this mixture so that the solids content of the mixture is from about 10 to about 75 weight percent. If necessary, a sufficient amount of ionic surfactant is added to the mixture to adjust the zeta potential of the ash and coal particles so that the zeta potential of the ash particles is from about −15 to about +15 millivolts and the zeta potential of the colloidal coal particles is from about −100 millivolts to about −15 millivolts or from about +15 millivolts to about +100 millivolts. The surfactant added at this stage may be the same as or different from the surfactant added to ball mill 132, and from about 0.01 to about 2.4 weight percent of ionic surfactant, based upon the dry weight of the coal, can be added at this stage. It is preferred, however, that the total amount of surfactant(s) added to ball mill 132 and zeta control tank 134 not exceed about 4.0 weight percent, based upon the dry weight of the coal. Alternatively, or additionally, one may add from about 0.05 to about 2.0 weight percent, based upon dry weight of coal, soluble salts of polyvalent cations such as calcium, magnesium, iron, aluminum, and the like.

The coal-water slurry from zeta control tank 134 is then passed at least onee through a coal-water slurry cleaning apparatus 138. Any of the coal-water slurry cleaning apparatuses known to those skilled in the art can be used in the process of this invention. Thus, by way of illustration and not limitation, one can use the electrophoretic deashing cell illustrated on page 3 (FIG. 3) of Miller and Baker s Bureau of Mines Report of Investigations 7960 (United States Department of the Interior, Bureau of Mines, 1974), the disclosure of which is hereby incorporated by reference into this specification. Thus, one can clean said slurry by passing it onto a sedimentation device, such as a lamella filter, where it is allowed to settle. Thus, one can effect magnetic separation of the slurry and/or combine such magnetic separation with sedimentation in the form of a pre- or post-treatment step.

The coal-water slurry from zeta control tank 134 can be cleaned by conventional cleaning processes other than electrophoretic deashing. Thus, by way of illustration, one can clean said slurry by passing said slurry onto a sedimentation device, such as a lamella filter, where it is allowed to settle. Thus, one can effect magnetic separation of the slurry and/or combine such magnetic separation with sedimentation in the form of a pre- or post-treatment step.

After the coal-water slurry from zeta control tank 134 has been cleaned, it preferably contains from about 0 to 13 weight percent of ash (based on dry weight of solids in the slurry). It is more preferred that the slurry contain from about 0 to 10 weight percent of ash at this point, and it is most preferred that the slurry contain from about 0 to 5 weight percent of ash.

The ash minerals from cleaning apparatus 136 are in a flocculated state and, because of this condition, can be passed by line 140 for disposal to ash and mineral sludge tank 142 and/or pond/144 and/or pressure filter 146. Waste water and/or sludge from tank 142 can be passed by line 148 directly to pond 144 and/or all or some of said water and/or sludge can be pumped by pump 150 to pressure filter 146. Waste from pressure filter 146 can be passed by line 152 to dump 154.

The coal from cleaning apparatus 136 is in a dispersed state and, when it has been subjected to a cleaning operation such as, e.g., electrophoretic cleaning, is at a solids content of from about 10 to about 75 weight percent solids. The concentration of the solids can be raised by any combination of the three methods mentioned below.

A portion of the cleaned coal-water slurry from ash and mineral sludge tank 142 can be passed by line 156 to coal-water slurry tank 158. The cleaned coal-water mixture in tank 158 can be flocculated by, e.g., adding a nonionic organic surfactant to the mixture, by reducing the pH of the mixture until flocculation occurs, by adding inorganic acid or inorganic acid salts as flocculating agents, or by other means well known to those skilled in the art. The flocculated coal obtained can be passed through line 60 and pump 62 to pressure filter press 64 to yield a cake with about 70 weight percent of solids. This cake can then be blended in ball mill 166 with a fraction of the deashed coal-water slurry from cleaning apparatus 134 through line 166 and/or the cake can be blended with a minor amount of relatively dry coal from crusher 130 which is passed through line 172 to ball mill 166. Sufficient amount of said cake and/or said deashed coal-water slurry from cleaning apparatus 134, and/or said crushed coal from crusher 130 and whatever additional carrier water and dispersing agent may be necessary, if any, are added to ball mill 166 so that the coal-water mixture to be ground contains from about 60 to about 80 volume percent of solids, from about 0.01 to about 4.0 weight percent, based on dry weight of coal, of dispersing agent, and from about 20 to about 40 volume percent of carrier water. This coal-water slurry is then ground in ball mill 166 until it has a particle size distribution substantially in accordance with the CPFT formula described in this specification.

The coal-water slurry produced in ball mill 166 can be passed by line 172 to storage tank 174. Successive charges of the slurry are blended continuously in tank 174, preferably by pumping it continously through a recycle pipeline 176 leading from the bottom of tank 174 to the top of tank 174 or by an agitator 175. Uniformity of the slurry is thus maintained.

A portion of the coal-water slurry may be recirculated through recycle line 178 from the bottom of ball mill 166 to the top of ball mill 166 to help control the particle size distribution in ball mill 166.

Figure 2:
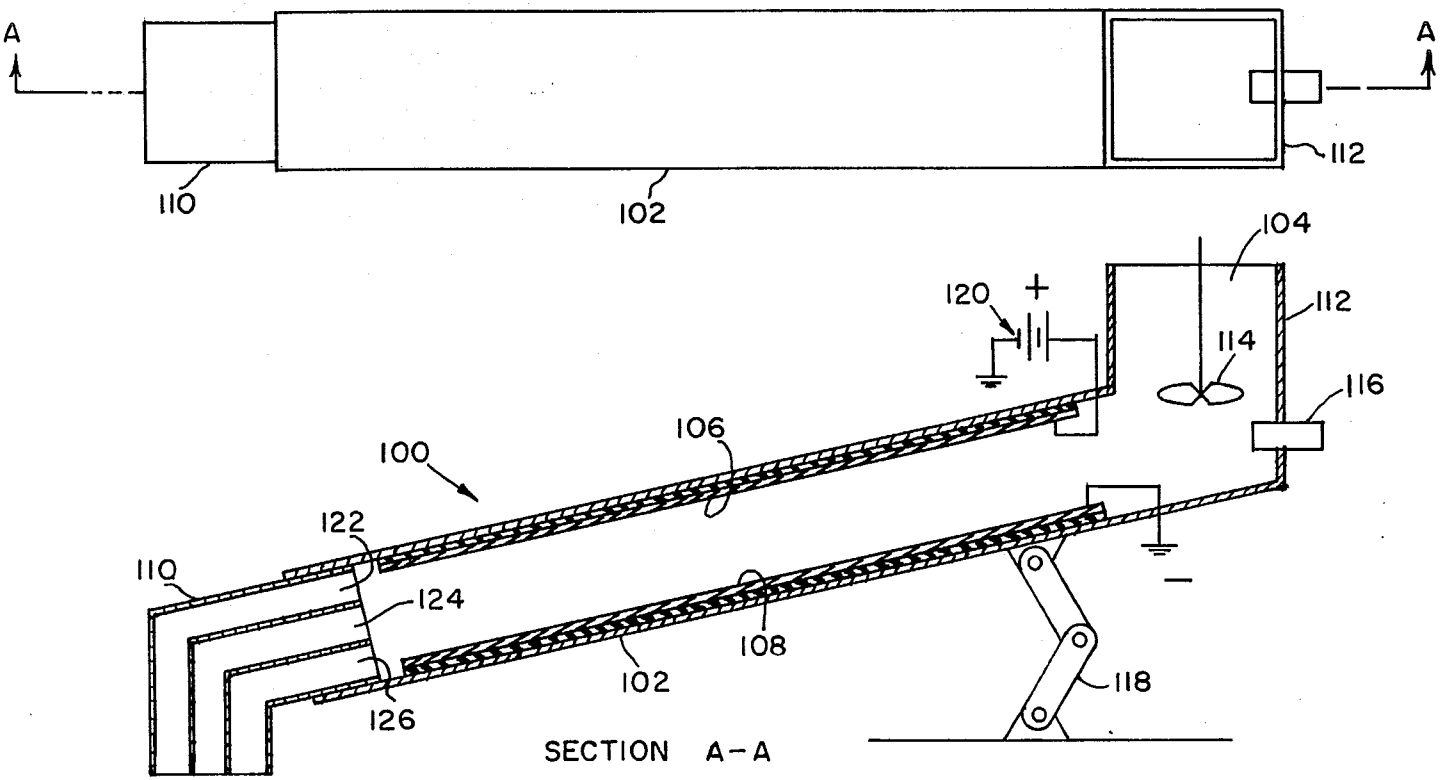
FIG. 2 illustrates an electrophoretic cell which can be used to prepare a deashed, stable coal slurry in accordance with one aspect of this invention and presents a cross-sectional and a plan view of said cell.

FIG. 2 shows one preferred embodiment of an electrophoretic deashing cell 100 that can be used in the present invention. However, as noted above, any conventional deashing cell can alternatively be used. The cell 100 includes a conduit 102 enclosing a passageway 104, a pair of electrodes 106 and 108, and a splitter 110 at the downstream end of the conduit 102. The cell 100 also includes a hopper 112 at the upstream end of the conduit with a stirrer 114 to mix the coal-water slurry charged to the hopper and with a pressure pulse generator 116 to assist in the counterflow of coal and ash mineral particles. Legs 118 may be used to raise or lower the conduit 102 to allow gravity to vary the flow rate and residence time between the electrodes.

The electrodes are preferably flat plate electrodes, preferably insulated from the conduit 102, which can be made of any suitable material, and preferably electrically insulating material. A voltage source 120 is connected across the electrodes to create a substantially vertically oriented electric field through the passageway and any slurry therein. Preferably the voltage source is a D.C. source with the top electrode 106 connected to the positive terminal and the bottom electrode 108 connected to the negative terminal. Both the coal and mineral particles are attracted to the positive terminal when both are negatively charged; however, only the coal particles rise because gravity exerts a larger force on the flocculated higher-density minerals causing them to fall toward the bottom of the passageway even against the influence of the electric field.

In another embodiment, the ash mineral particles are charged to from about −10 to about +15 millivolts, and the coal particles are charged to from about −15 to −85 millivolts. In this embodiment, the ash minerals are attracted to bottom electrode 108 and repelled by top electrode 106, thereby assisting gravity in the separation of the coal and the ash particles.

The splitter 110 as shown in FIG. 2, preferably includes three separate discharge openings including upper opening 122 for coal and water, intermediate opening 124 for water and lower opening 126 for minerals (ash) and water. The intermediate opening 124 can be omitted, if desired. The voltage can be varied by any suitable means depending on the type and viscosity of the slurry, the slope of the conduit, and the speed of the flow therethrough, and in response to the quality of the deashing achieved with the previous voltage differential.

A typical voltage difference between the two electrodes is preferably in the range of from about 5 volts to about 100 volts. The distance between the electrodes is preferably in the range of from about 2 to about 4 centimeters. The flow is preferably in the range of from about 0.1 to about 10 centimeters per second, and most preferably from about 0.1 to about 3 centimeters per second.

The ash minerals from the cleaning apparatus are in a flocculated state and, thus, can be passed to an ash and mineral sludge tank and/or a pond and/or a pressure filter.

The coal from the cleaning apparatus is in a dispersed state and, after having been cleaned, is at a solids content of from about 10 to about 73 weight percent. The concentration of the coal can now be increased by several different methods. In one method, the coal is passed to a coal-water slurry tank wherein it is flocculated by known methods; one can flocculate by, e.g., adding a nonionic organic surfactant to the coal-water mixture, by reducing the pH of the mixture until flocculation occurs, by adding inorganic acid or inorganic acid salts as flocculating agents, or by other means well known to those skilled in the art. The flocculated coal thus obtained can be passed to a pressure filter press to yield a cake with a solids content of greater than 60 volume percent of solids. This cake can then be blended in a ball mill with a fraction of the deashed coal-water slurry from the cleaning apparatus and/or the cake can be blended with a suitable amount of relatively dry coal from the coal crusher. Sufficient amounts of said cake and/or said deashed coal-water slurry from the cleaning apparatus, and/or said crushed coal from crusher 30 and whatever additional carrier water and dispersing agent may be necessary, if any, are added to ball mill so that the coal-water mixture to be ground contains from about 60 to about 80 volume percent of solids, from about 0.01 to about 4.0 weight percent, based on dry weight of coal, of dispersing agent, and from about 20 to about 40 volume percent of carrier water. This coal-water surry is then ground in the ball mill until it has a particle size distribution substantially in accordance with the CPFT formula described in this specification.

In one of the embodiments of this invention, the charges of the ash particles and the coal particles in the slurry are modified before the slurry is cleaned. In this embodiment, different charges can be imparted to the ash and coal particles by various means. Thus, one can add two or more chemicals to the system, each of which have different affinities for and/or different effects upon the charge of the ash and coal particles; one might, e.g., add one ionic surfactant for the ash particles and a separate ionic surfactant for the coal particles. Thus, one can use purely electrical charging means well known to those in the art to impart the differential charge. Thus, e.g., one can add one chemical to the system which, because of the different chemical and physical properties of the coal and ash particles, will have different effects upon the charges of said particles.

In one preferred embodiment, an ionic dispersant which has the capability of charging the carbonaceous and non-carbonaceous materials to the specified zeta potentials is utilized. In another preferred embodiment, two or more ionic dispersants, each of which selectively charges either the carbonaceous coal particles and/or the ash particles to the specified levels, are utilized.

It is desirable to have a coal-water slurry which, regardless of whether it is subjected to a constant shear with time, an increasing shear rate, and/or an increasing temperature has its viscosity decrease; the coal-water slurry of this invention unexpectedly possesses these properties.

The viscosity of the most preferred coal-water slurry of this invention decreases at a constant shear rate with time, decreases at an increasing shear rate, and decreases at an increasing temperature. This property greatly enhances its pumpability.

In one preferred embodiment, the coal-water slurry of this invention is a yield-pseudoplastic fluid. The term "yield pseudoplastic fluid", as used in this specification, has the usual meaning associated with it in the field of fluid flow. Specifically, a yield pseudoplastic fluid is one which requires that a yield stress be exceeded before flow commences, and one whose apparent viscosity decreases with increasing rate of shear. In a shear stress vs shear rate diagram, the curve for a yield pseudoplastic fluid shows a non-linearly increasing shear stress with a linearly increasing rate of shear. In a "pure" pseudoplastic system, no yield stress if observed so that the curve passes through the origin. However, most real systems do exhibit a yield stress indicating some plasticity. For a yield pseudoplastic fluid, the viscosity decreases with increased shear rate.

In the most preferred embodiment of this invention, the coal-water slurry of this invention is also thixotropic, i.e., its viscosity decreases with time at a constant shear rate. Furthermore, in this embodiment, the coal-water slurry has a negative temperature coefficient of viscosity, i.e., its viscosity decreases with increasing temperature.

Figure 3:
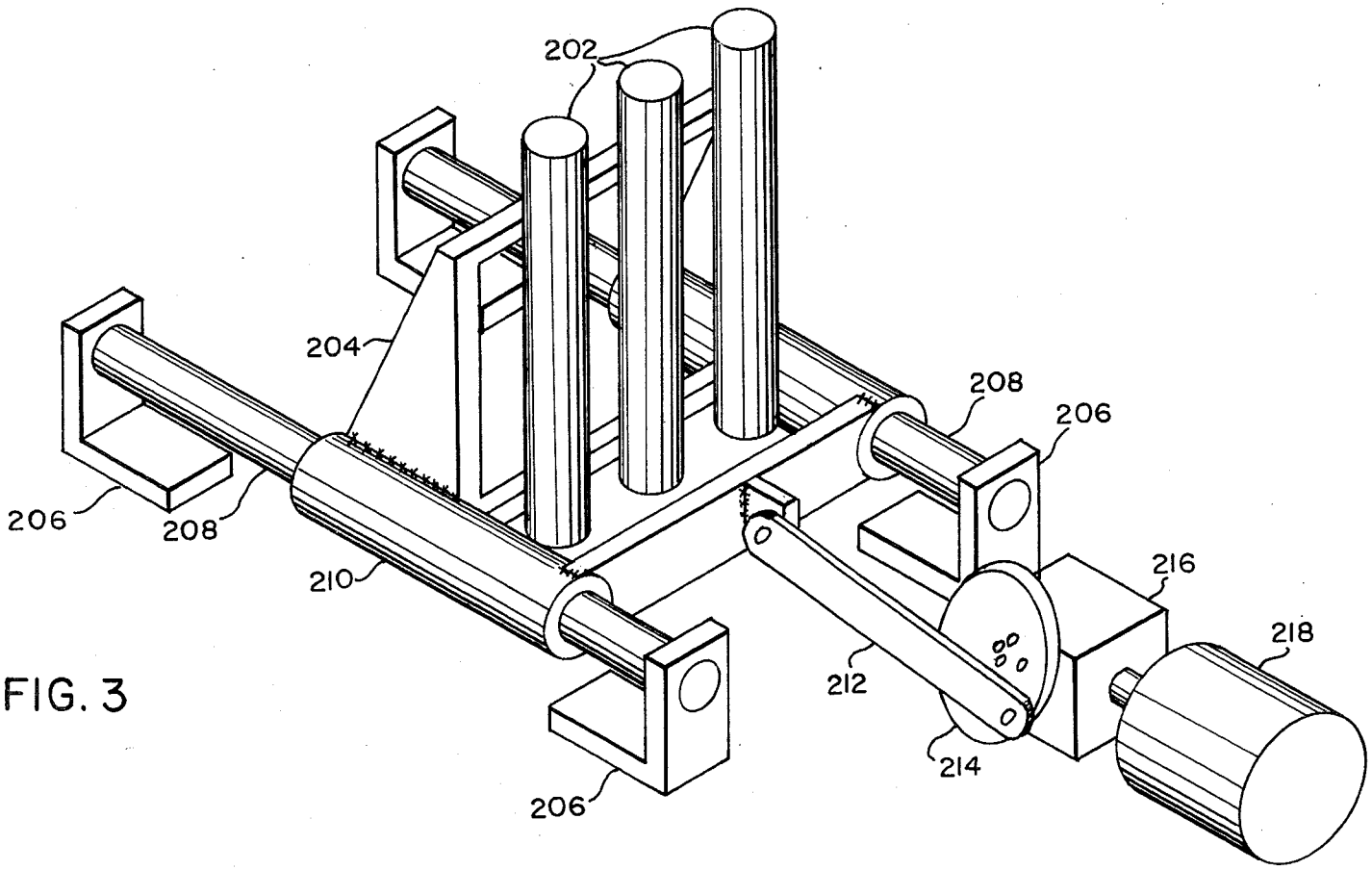
FIG. 3 is a schematic of a stability tester which can be used to determine the stability of carbonaceous solids-fluid slurry; the tester illustrated is a variable frequency, variable amplitude oscillator.

FIG. 3 is a schematic diagram of the device used to measure the stability of a slurry which can simulate the accelerations above normal gravity, called "G-stresses", which may be encountered in transportation. Two horizontal shafts 208 are fixed to the base 206 which are then mounted to a stable platform such as the floor. Settling columns 202 which may be made from glass, plastic, steel or any convenient container material 100 centimeters high by from 2 to 10 centimeters inside diameter are mounted on the carrier frame 204. Carrier frame 204 is welded to two bearing tubes 210 which allow the carrier frame with the settling columns 202 to oscillate back and forth in a horizontal plane on the shafts 208. The driving force for oscillation is provided by a variable speed motor 218 through a right angle gear box 216 to a crank wheel 214. Crank arm 212 is pivoted at one end to carrier 204 and at the other end to crank arm 212 at various lengths of the crank wheel 214 radius.

By varying the speed of the motor 218 the frequency of oscillation can be varied. By varying the pivot point of crank arm 212 on the radius of crank wheel 214, the amplitude can be varied.

The total net acceleration under any combination of frequency and amplitude is given by $$A_{xy}^2 = A_x^2 + A_y^2$$

where $A_x$=acceleration of the crank wheel in the X direction $A_y$=acceleration of the crank wheel in the y direction Typical results of these calculations are given in Table 7.

TABLE 7

| Frequency | Amplitude | G Stresses |
|---|---|---|
| 600/min | 0.110 inches | 1.5 |
| 600/min | 0.168 inches | 2.0 |
| 60/min | 7.750 inches | 1.5 |
| 60/min | 10.900 inches | 2.0 |

FIG. 5 illustrates one means of evaluating the effectiveness of surfactants for any given solid material. The curves of FIG. 5 represent data obtained using both a purported nonionic polymer CW-11 made by the Diamond Shamrock Process Chemicals Co. and an anionic lignosulfonate The following examples are presented to illustrate certain aspects of the claimed invention but are not to be deemed limitative thereof. Unless otherwise stated, all parts are by weight and all temperatures are in degrees centigrade.

EXAMPLE 1

Procedure for Screening and Selecting Dispersing Agents

A surfactant or combination of surfactants effective for use in practicing the invention may be found by either of the two following methods.

(a) Zeta potential measurement.

In general, a sample of coal is ground in a laboratory size porcelain ball mill with porcelain balls in water at 30 wgt. % solids for approximately 24 hours to insure that all the particles are $<10\ \mu m$. Small samples of this larger sample are then prepared in a known way by placing them in a vessel equipped with a stirrer with a sample of water to be used as a carrier. Various acidic and basic salts are then added in incremental amounts to vary the pH, and various concentrations of various candidate dispersing agent organic surfactants likewise are added in incremental amounts (e.g. grams per gram coal, both dry basis), alone or in combinations of two or more. These samples are then evaluated in any electrophoretic mobility, electrosomosis, or streaming potential apparatus to measure electrical potentials, from which the zeta potential is calculated in a known way. Plots of zeta potential vs pH vs concentration may then be made to indicate candidate surfactants, or combinations thereof to be used to produce the optimum dispersion of coal particles in the carrier water below the amount at which dilatency may be reached. A Pen Kem System 3000 apparatus is used in the determination described and can process 40 samples in about 6 hours.

(b) Alternate method for estimating equivalent zeta potential.

A large sample of coal is ground in water as described in (a) above at 50 wgt. % solids for about 2 to 4 hours to produce a slurry.

Smaller samples, about 500 ml, of this slurry are then deflocculated by adding various candidate dispersing agent surfactants and surfactant combinations to the sample of slurry, as above, dry or, preferably, in solution, dropwise, blending gently, and then measuring the viscosity at some constant shear rate (e.g., using a Brookfield LVT viscometer at 30 rpm). A surfactant system which is found to produce an acceptably low, preferably the lowest viscosity at the lowest amount, e.g. in wgt. % of addition on a dry coal basis is thereby identified as the most effective surfactant.

EXAMPLE 2

Preparation of Coal Samples for Measurements (a) Sieve analysis.

Although any standard procedure may be used to measure particle sizes of coal particles from a coal and then to calculate the particle size distribution, the procedure used in obtaining data discussed herein will be described.

A weighed sample, e.g. 50 grams dry wgt. of coal is dispersed in 400 ml of carrier water containing 1.0 wgt. % Lomar D based on a weight of coal, dry basis, and the slurry is mixed for 10 minutes with a Hamilton Beach mixer. The sample is then allowed to stand quiescent for 4 hours, or preferably, overnight. (This step usually is not necessary if the slurry was milled with surfactant).

The sample is then remixed very briefly. It then is poured slowly on a stack of tared U.S. Standard sieves over a large vessel. The sample is carefully washed with running water through the top sieve with the rest of the stack intact until all sievable material on that sieve is washed through the sieve into the underlying sieves. The top sieve is then removed and each sieve in the stack, as it becomes the top sieve, is successively washed and removed until each sieve has been washed. The sieves are then dried in a dryer at 105 C. and the residue on each is weighed in a known way.

(b) Sedigraph analysis.

A separate sample finer than 140 mesh sieve size is carefully stirred and a representative sample (about 200 ml) is taken for analysis. The rest may be discarded.

About 2 eyedroppers of the dilute slurry are further diluted in 30 ml of distilled water with 4 drops of Lomar D added. This sample is stirred overnight with a magnetic stirrer. Measurement is then made with the Sedigraph 5500L.

The Sedigraph 5500L uses photo extinction to measure particles. It essentially measures projected area of shadows and the data must be converted to volume-%-finer-than. The data from the sieve and Sedigraph is combined to prepare a CPFT chart. $D_s$ at 1% is read from the CPFT line.

EXAMPLE 3–12

Preparation of Consist of Ohio #6

335 pounds of 4×0 Ohio No. 6 bituminous coal with a Hardgrove grindability index (HGI) of 50 and a free swelling index (FSI) of 3.5, 6.0 pounds of water, 0.1 weight % (0.1 weight %) of sodium hydroxide, and 1.1 weight %, (1673 grams) of Lomar D (the sodium salt of a condensed alkyl mononaphthalene sulfonic acid sold by the Diamond Shamrock Process Chemicals, Inc. of Morristown, N.J.) were charged in a Kennedy Van Saun 3 ft diameter×5 ft long ball mill (manufactured by the Kennedy Van Saun Co. of Danville, Pa). The ball mill had 35 volume % of a 2.0 inch top Bond ball charge and was comprised of 34 weight % of balls of 2.0 inch diameter, 43 weight % of balls of 1.5 inch diameter, 17 weight % of balls of 1.25 inch diameter, and 6 weight % of balls of 1.0 inch diameter.

The ball mill was run at a speed of 33 revolutions per minute, which corresponded to 70 percent of the critical speed of the ball mill. Grinding was conducted in the mill under these conditions until about 98.5 weight percent of the coal particles passed through a 50 mesh screen; during the grinding, samples of the slurry were periodically evaluated to determine the fineness of the coal in the slurry.

In substantial accordance with the procedure of EXAMPLE 2, the particle size distribution of the slurry produced in the ball mill were determined by sieve analysis and by Sedigraph 5500L analysis. The sieve analysis indicated the amount of coal particles in the slurry consist which ranged from about 53 microns (270 mesh) to the largest size coal particle in the slurry (about 1180 microns). The Sedigraph analysis indicated the amount of coal particles in the slurry consist which ranged from about 74 microns to the smallest size coal particle in the slurry which was present in a concentration of at least 1 weight percent. The sieve analysis data and the Sedigraph analysis data were then merged to yield the volume percent of the various sized particles in the slurry. Thereafter, based upon the assumption that all of the particles in the slurry were spherical, the specific surface area and the porosity of the coal particles in the slurry consist were calculated.

The slurry consist of this EXAMPLE 3 had a porosity of 8.096 volume percent and a specific surface area of 1.015 $m^2/cc^3$. This slurry produced a yield stress of about 1.0–2.0 Pascals at 70 volume percent solids and was unstable. The slurry had a Haake viscosity of 2500 cps at 100 $sec^{-1}$.

Portions of unstable slurry produced in substantial accordance with EXAMPLE 3 were diluted to concentrations of either 40 weight percent, 50 weight percent, or 60 weight percent, and each of these diluted portions was separately ground in a Draiswerke stirred ball mill (model number PM 25–40 STS/DDA, manufactured by Draiswerke Inc. of Allendale, N.J.). The 40 percent samples were fed to the ball mill at a feed rate of 100 pounds per hour; the 50 percent samples were fed at a rate of 300 pounds per hour; the 60 percent samples were fed at a rate of 450 pounds per hour. The ball mill was run at an internal shaft speed of 520 r.p.m. The grinding media were 2 mm diameter steel balls. The product produced by the grinding at 40% solids in the Draiswerke stirred ball mill had a $D_s$ of 6.4 μm and a median size of 21.623 μm. The surface area was 5.582 $m^2/cm^3$ and the porosity 19.44 percent. The product produced by grinding at 50% solids in the Draiswerke stirred ball mill had a $D_L$ of 9.3 μm and a median size of 2.561 μm; the surface area was 3.962 $m^2/cm^3$, and the porosity 16.85 percent. The product by grinding at 60% solids in the Draiswerke stirred ball mill had a $D_s$ of 19.6 μm and a median size of 4.766 μm; the surface area was 2.639 $m^2/cm^3$, and the porosity 12.69 volume percent.

The procedure of EXAMPLE 3 was repeated, with the exception that a different charge was put in an Abbe ball mill instead of a KVS ball mill. Instead of using 100 weight percent of dry Ohio No. 6 bituminous coal, the charge now contained either 5 weight percent, 10 weight percent, or 15 weight percent of one of the reground coals produced in the Draiswerke stirred ball mill (by weight of coal). The dry coal/slurry/water/-surfactant mixture was then ground in the Abbe ball mill in accordance with the procedure of this EXAMPLE 3, but the surfactant concentration in the mixture was still 1.1 weight percent (no surfactant or caustic was added when the fine portions were ground).

The properties of the slurries obtained are indicated below in Table 8.

TABLE 8

| Example # | weight % slurry added to Abbe mill | type fines added | Volume percent solids | Porosity % | Surf. area $m^2/cm^3$ | Bingham viscos. cP | Zeta pot. mV |
|---|---|---|---|---|---|---|---|
| 3 | 0 | | 64 | 7.3 | 0.96 | 1300 | −43.36 |
| 4 | 5A | 40% | 64 | 6.90 | 1.16 | 1500 | −42.67 |
| 5 | 10A | 40% | 64 | 10.97 | 1.2 | 1250 | −42.29 |
| 6 | 5 | 40% | 64 | 6.21 | 1.80 | 1850 | −44.59 |
| 7 | 5B | 50% | 64 | 7.47 | 1.08 | 1800 | −38.57 |
| 8 | 10B | 50% | 64 | 6.43 | 1.38 | 1150 | −40.53 |
| 9 | 15B | 50% | 64 | 6.68 | 1.38 | 1700 | −40.78 |
| 10 | 5C | 60% | 64 | 9.30 | 0.97 | 1350 | −33.94 |
| 11 | 10C | 60% | 64 | 6.30 | 1.02 | 1850 | −44.13 |
| 12 | 15C | 60% | 64 | 4.99 | 1.18 | 1200 | −41.52 |

EXAMPLES 13–16

The procedure of EXAMPLES 3–12 was repeated with the exception that a different fine grinding machine was used—a Union Process Attritor, model C-10 (manufactured by the Union Process Company of Akron, Ohio). The 40 percent samples were fed to the Attritor at a feed rate of 42 lb/hr, the 50 percent samples were fed to the Attritor at a feed rate of 60 lb/hr; and the 60 percent samples were fed to the Attritor at a feed rate of 89 lb/hr. The Attritor stirrer was run at a speed of about 312 r.p.m. using ¼" steel balls. The product produced by the grinding in the Attritor at 40 percent solids was 99.5%<53 μm with a median size of 5.690 μm; the surface area was 2.060 $m^2/cm^3$, and the porosity was 14.33 volume percent. The product produced by grinding in the Attritor at 50 percent solids was 99.5%<53 μm with a median size of 6.95 μm; the surface area was 2.029 $m^2/cm^3$, and the porosity 11.91 volume percent. The product produced by grinding in the Attritor at 60 percent solids was 99.5%<53 μm with a median size of 6.93; the surface area was 2.22 $m^2/cm^3$, and the porosity was 10.15 volume percent.

The properties of the slurries obtained in these examples are indicated below in Table 9.

TABLE 9

| Example # | weight % slurry added to Abbe mill | type fines added | Volume percent solids | Porosity % | Surf. area $m^2/cm^3$ | Bingham viscos. cP | Zeta pot. mV |
|---|---|---|---|---|---|---|---|
| 13 | 5 | 50% | 64% | 6.27 | 1.23 | 5200 | 35.15 |
| 14 | 15 | 50% | 64% | 5.64 | 1.20 | 1700 | −38.62 |
| 15 | 5 | 60% | 64% | 10.58 | 0.91 | 1200 | −43.23 |
| 16 | 15 | 60% | 64% | 10.62 | 1.02 | 1050 | −43.01 |

EXAMPLES 17–22

The procedure of EXAMPLES 5–12 was repeated with the exception that an Abbe ball mill was used for regrinding of the slurry; the coarse slurry was first ground, and portions of the coarse slurry were reground in an Abbe ball mill (model Double No. 2, manufactured by the Paul O. Abbe Company of Littls Falls, N.J.) This ball mill had 35% volume of 2.0 inch top Bond ball size and was run at a speed of 34 revolutions per minute, which corresponded to 51 percent of the ball mill critical speed. The slurry was reground at concentrations of 40%, 50%, and 60%, and mixtures of reground coal/cry 4×0 coal/surfactant/water were then ground. No additional surfactant was added during the regrinding of the slurry, and the surfactant concentration in the coal/reground slurry/water/surfactant mixture contained 1.1 weight percent of surfactant and 0.2 weight percent of caustic.

The regrinding of the coarse slurry was conducted in the Abbe mill for 24 hours using ½ inch steel balls and a grinding speed of 46.5 r.p.m. (70 percent of critical speed) The slurry reground at 40% solids was 99.5%<7.7 μm with a median size of 1.975 μm, the surface area was 4.59 $m^2/cm^3$, and the porosity was 18.44 volume percent. The slurry reground at 50% solids was 99.5<13.4 μm with a median size of 2.661 μm, the surface area was 3.96 $m^2/cm^3$ and the porosity was 15.26 volume percent. The slurry reground at 60% solids was 99.5%<2.84 μm with a median size of 4.97 μm, the surface area was 2.90 $m^2/cm^3$, and the porosity was 11.54 volume percent.

The properties of the slurries obtained in this EXAMPLE are indicated below in Table 10.

TABLE 10

| Example # | weight % slurry added to Abbe mill | type fines added | Volume percent solids | Porosity % | Surf. area $m^2/cm^3$ | Bingham viscos. cP | Zeta pot. mV |
|---|---|---|---|---|---|---|---|
| 17 | 10 | 40% | 64% | 5.322 | 1.120 | 1200 | −41.9 |
| 18 | 15 | 40% | 64% | 6.523 | 1.583 | 1900 | −40.1 |
| 19 | 10 | 50% | 64% | 5.483 | 1.139 | 1750 | −38.9 |
| 20 | 15 | 50% | 64% | 6.289 | 1.432 | 1250 | −43.2 |
| 21 | 10 | 60% | 64% | 6.110 | 1.280 | 1500 | −40.8 |
| 22 | 15 | 60% | 64% | 5.752 | 1.336 | 1900 | −40.6 |

EXAMPLES 23–24

317.5 pounds of 4×0 Dorothy seam bituminous coal with a Hardgrove grindability index of 46 and a Free Swelling Index of 7.5, 105.8 pounds of water, 1008 grams (0.7 weight percent) of Lomar D, and 144 grams of caustic (0.1 weight percent) were charged to a Kennedy Van Saun ball mill which had an internal diameter of 3.0 feet and was 5.0 feet long. The ball mill had a 2.0" top Bond ball charge, a 35 volume percent ball charge and had the same percent of 2.0", 1.5", 1.25", and 1.0" balls as did the Abbe mill of EXAMPLE 3. The mill was run at a speed of 28.5 r.p.m. (60 percent of its critical speed). Grinding was conducted until about 98.5 weight percent of the coal particles passed through a 50 mesh screen; during the grinding, samples of the slurry were periodically evaluated to determine the fineness of the coal in the slurry.

The particle size of the slurry was analyzed in accordance with the procedure described in EXAMPLE 2. The slurry consist of this EXAMPLE 23 had a porosity of 6.451 volume percent and a spedific surface area of 1.25 $m^2/cm^3$.

A portion of the unstable slurry of EXAMPLE 23 was diluted to a concentration of 60 weight percent solids, and this portion was reground in a Union Process Attritor, model C-10 (manufactured by the Union Process Company of Akron, Ohio) at a feed rate of 13.5 gal/hr, a speed of 312 r.p.m. using ¼" steel balls.

The procedure of EXAMPLE 23 was repeated, with the exception that the charge to the ball mill was modified. Instead of using 100 weight percent of 4×0 Dorothy seam coal, the charge now contained 85 weight percent of the 4×0 Dorothy seam coal and 15 weight percent of the coal reground in the Attritor. The mixture was then ground in the ball mill at 76 weight percent solids.

The properties of the slurries obtained in EXAMPLES 23 and 24 are shown below in Table 11. EXAMPLE 23 related to the experiment where no reground fine particles were added to the slurry and reground; in EXAMPLE 24, reground fine particles were added to the slurry and reground. No stabilizers were added. This slurry was transported by truck about 200 miles and stored in drums for 3 weeks and evidenced no settling.

TABLE 11

| Example # | weight % fines added to mill | Volume percent solids | Porosity % | Surf. area $m^2/cm^3$ | Bingham viscos. cP 100 $sec^{-1}$ |
|---|---|---|---|---|---|
| 23 | 0% | 66% | 6.45 | 1.25 | 1270 |
| 24 | 15% | 68% | 11.43 | 1.14 | 1630 |

EXAMPLES 25–26

The procedure of EXAMPLES 23 and 24 were repeated with the exception that 4×0 Pittsburgh seam coal (with a Hardgrove grindability index of 60 and a free swelling index of 7.0) was used instead of the Dorothy seam coal, 1.0 weight percent of Lomar D was used instead of 0.7 weight percent of said surfactant, and the feed rate of the slurry in the Attritor was 25.8 gal/hr instead of 13.5 gal/hr.

The results of these experiments are shown in Table 12. In EXAMPLE 25, no reground fine particles were added to the slurry and reground with coal; in EXAMPLE 26, reground fine particles were added to the slurry and reground. No stabilizing chemicals were added. This slurry was transported 200 miles by truck and stored in drums for 3 weeks and evidenced no settling.

TABLE 12

| Example # | weight % fines added to mill | Volume percent solids | Porosity % | Surf. area $m^2/cm^3$ | Bingham viscos. cP 100 $sec^{-1}$ |
|---|---|---|---|---|---|
| 25 | 0% | 65% | 7.05 | 1.24 | 900 |
| 26 | 15% | 67.5% | 6.91 | 1.17 | 1900 |

EXAMPLES 27–34

About 1750 grams of the unstable Ohio No. 6 coal slurry produced in accordance with the procedure of EXAMPLE 3 were used in the EXAMPLES and mixed with 5 weight percent of coal fines, 10 weight percent of coal fines, 15 weight percent of coal fines, and 20 weight percent of coal fines. Coal fines produced in accordance with the procedure described in EXAMPLES 7, 8 and 9 (wherein the slurry was reground in a Draiswerke stirred ball mill to generate the fines) were utilized and were hand mixed with the slurry for about 10–15 minutes. Then the slurry was analyzed for its solids content, its concentration was adjusted to 70 weight percent of solids.

One sample of each of the slurries, comprised of about 200 grams dry weight had Lomar D added to it in increments of 0.2 grams while its viscosity was monitored. The concentration of Lomar D which gave the minimum slurry viscosity for the slurry was noted.

One sample of each of the slurries, comprised of about 200 grams of coal, had the amount of Lomar D which minimized its viscosity added to it. Thereafter, the viscosity and shear stress for each of these samples was measured in a Haake viscometer (model number RV3, manufactured by Haake, Inc. of West Germany). The shear stress data was extrapolated to yield stress data by techniques known in the art.

This experiment was repeated, with the exception that 100 microliters of 2M calcium chloride were added to each of the slurry samples.

EXAMPLES 27, 28, 29, and 30 relate to slurry containing 5 percent, 10 percent, 15 percent, and 20 percent of fines, respectively, which did not contain calcium chloride. EXAMPLES 31, 32, 33, and 34 relate to the slurries containing 5 percent, 10 percent, 15 percent, and 20 percent of fines, respectively, which did contain calcium chloride. The results of this experiment are presented below in Table 13.

TABLE 13

| Example # | weight % fines | amount $CaCl_2$ | Yield stress Pa | Porosity % | Surf. area $m^2/cm^3$ | Bingham Viscosity cp 100 $s^{-1}$ | Zeta pot. |
|---|---|---|---|---|---|---|---|
| 27 | 5 | 0 | 9.5 | 6.15 | 1.18 | 2550 | −46.83 |
| 28 | 10 | 0 | 8.0 | 6.90 | 1.33 | 2200 | −41.10 |
| 29 | 15 | 0 | 7.0 | 7.72 | 1.47 | 2100 | −41.86 |
| 30 | 20 | 0 | 15.0 | 8.44 | 1.62 | 3230 | −39.20 |
| 31 | 5 | .037% | 12.5 | 6.15 | 1.18 | 3000 | −39.58 |

TABLE 13-continued

| Example # | weight % fines | amount $CaCl_2$ | Yield stress Pa | Porosity % | Surf. area $m^2/cm^3$ | Bingham Viscosity cp 100 $s^{-1}$ | Zeta pot. |
|---|---|---|---|---|---|---|---|
| 32 | 10 | .037% | 13.0 | 6.90 | 1.33 | 2500 | −36.63 |
| 33 | 15 | .037% | 15.0 | 7.72 | 1.47 | 2300 | −40.82 |
| 34 | 20 | .037% | 21.0 | 8.44 | 1.62 | 3900 | −42.59 |

EXAMPLE 35

In this EXAMPLE, a coal mixture comprised of a blend of coal from Virginia, Kentucky, and West Virginia was used; this coal was supplied by the United Coal Company of Bristol, Virginia, it had a Hardgrove grindability index of about 50, it had a volatile content (dry basis) of 42.25 percent, and it contained 1.66 weight percent of ash (on a dry basis).

A 7.23 pound portion of this coal together with 3.23 pounds of water were charged in an 8.0" diameter steel ball mill with ½" steel balls. Grinding was conducted at 50 percent ball charge loading at about 50 r.p.m. for about 20 hours. The ground coal produced in this ball mill was 99.5%<11.9 um, with a median size of 8.23 um. The surface area was 1.48 $m^2/cm^3$, and porosity was 12.31 percent.

A 13.85 pound sample of this coal was crushed in a roll crusher to a 4×0 mesh consist. The crushed coal was then charged to a 16.0" diameter Abbe mill with 2" top Bond ball charge (see EXAMPLE 22 for a description of this mill) together with the 4.60 pounds of the fine coal slurry produced in the 8.0" diameter mill, 3.28 pounds of water, 7.4 grams of caustic, and 51.8 grams of Lomar D. This mixture was ground until the mixture contained at least about 98.5 percent of the coal particles which passed through a 50 mesh screen. The coal slurry thus produced contained no more than about 1.66 weight percent of ash (dry basis). The slurry had a viscosity of about 1030 centipoise at 71 weight percent solids at 100 $sec^{-1}$. Particle size analysis of the coal consist of the slurry indicated that the consist had a porosity of 5.11 percent, and a specific surface area of 0.94 $m^2/cm^3$.

EXAMPLES 36–40

In these EXAMPLES, the coal used was a low-volatile Upper Freeport coal from West Virginia with a Hardgrove grindability index of about 88 and a Free Swelling Index of 9.0. Into a Kennedy Van Saun 3.0' internal diameter by 5.0 foot ball mill (which is described in EXAMPLE 3) was charged 335 pounds of dry coal, 94.5 pounds of water, (78 weight percent of solids), 2.35 pounds of Lomar D, and 0.335 pounds of sodium hydroxide. The coal-water mixture was ground in accordance with the procedure of EXAMPLE 3. The slurry so produced was subjected to particle size analysis and found to have 99.5%<297 um with a median size of 38.73 um. The specific surface area of the slurry consist was 1.57 $m^2/cm^3$, the yield stress of the slurry was 3.0 Pascals, the solids content (by volume) of the slurry was 69.4, and the porosity of the slurry consist was 5.6%. The slurry was unstable.

In EXAMPLES 36–40, from 0.016% to 0.054% of various chemicals designed to affect the yield stress properties of the slurry were added to the slurry by (1) charging the slurry to the cup of a Haake viscometer, (2) hand stirring the slurry, and adding the chemical under ambient conditions. The slurry-chemical mixture was then tested in the Haake viscometer and its yield stress extrapolated from the shear stress data generated; the test was conducted at least 5 minutes after the chemical was mixed with the slurry.

The chemicals tested in these EXAMPLES were chosen for their ability to affect the zeta potential (and thus, the yield stress) of the colloidal particles in the coal consist. Without being bound by any theory, applicant believes that these chemicals are effective to alter the zeta potential of the colloidal coal particles because they either (1) increase the valence and/or the concentration of the counterions in the slurry system, or (2) increase the thickness of the shear plane of the colloidal particle, thereby developing a gel structure in the slurry. Reference should be made to standard D.L.V.O. theory for a discussion of these phenomena.

Table 14 describes these experiments and indicates the type of additive, the amount of additive, and the yield stress, porosity, specific surface area, and the solids content of the resulting slurries.

TABLE 14

| EXAMPLE # | Type of Additive | Percent Additive (dry basis) | Volume Percent Solids | Yield Stress Pa | Surface Area ($m^2/cm^3$) | Porosity (%) |
|---|---|---|---|---|---|---|
| 36 | $CH_3COOH$ | 0.036 | 69.4 | 5. | 1.59 | 5.6 |
| 37 | $H_3OOH$ | 0.054 | 69.4 | 8. | 1.59 | 5.6 |
| 38 | $CaCl_2$ | 0.017 | 69.4 | 4.5 | 1.59 | 5.6 |
| 39 | $CaCl_2$ | 0.033 | 69.4 | 7. | 1.59 | 5.6 |
| 40 | $CaCl_2$ | 0.050 | 69.4 | 8. | 1.59 | 5.6 |

EXAMPLE 41

Low-volatile Upper Freeport coal from Bayard, West Virginia was used to prepare a coal-water slurry comprised of 75.2 weight percent solids which had a Haake viscosity (measured on the Haake viscometer) of 1000 centipoise at 100 $sec.^{-1}$. This slurry was mixed with a volume of ethanol equal to about 60 percent of its volume and then allowed to dry for four days at about 60° centigrade at the end of which time its solids content was measured and found to be about 93.9% by weight. To 276.8 grams of this coal was added 131.0 grams of #2 fuel oil. This gave a slurry of about 63.7% by weight. The specific gravity of the oil was found to be about 0.8298 grams by a pycnometer method at ambient conditions. Therefore the slurry was about 52.2% coal by volume.

This slurry was measured on the Haake viscometer. It was found to be continuously shear thinning (or pseudaplastic) up to 500 $sec^{-1}$ and above. The minimum viscosity under varying viscometer conditions varied between about 250 cps and about 60 cps at 70° F.

Coal water slurries of this type usually double in viscosity, with about every 2.5 wgt % increase in solids. If that rule may be applied here, using 250 cps at 63.7% by weight coal, the slurry would be about 2000 cps at 71.2% coal by weight. Using 60 cps as a starting point, the slurry would be 76.2% coal by weight at 2000 cps.

EXAMPLE 42

In this example, samples of petroleum coke from an oil refinery in MacPherson, Kansas were used as feedstock for the 16" Abbe ball mill. This material has a very high carbon content, low ash, and low volatile residue remaining from the fractionation of crude oil. The as received material was crushed to a 4×0 mesh consist in a roll crusher. 16.3 lbs was then ground in a single step process, with water under varying conditions, in the 16" Abbe ball mill as tabulated below, and with the properties shown. The ball mill was run at a mill speed of 34 RPM, or 51% of critical speed, and the ball charge was a 2 inch top Bond ball charge, containing 34% by weight 2 inch balls, 43% by weight 1½ inch balls, 17% by weight 1¼ inch balls, and 6% by weight 1 inch balls. The ball charge loading was 34% of the mill volume.

Table 15 gives these results

TABLE 15

| Grinding Conditions | | | Product Slurry | | | | |
|---|---|---|---|---|---|---|---|
| Weight % solids | Lomar D % | NaOH % | % <50 M | % <200 M | S.A. $m^2/cm^3$ | Poros. % | Bingham Viscos. cP |
| 73 | 0.7 | 0.1 | 99.25 | 67.99 | | | |
| 75 | 0.7 | 0.1 | 99.49 | 69.36 | 1.04 | 6.53 | |
| 78 | 0.7 | 0.1 | 99.69 | 72.07 | 1.54 | 7.87 | 810 @ 75% |
| 78 | 0.5 | 0.1 | 99.16 | 66.67 | 1.31 | 6.50 | 900 @ 75% |
| 78 | 0.7 | 0.1 | 99.02 | 70.64 | 1.61 | 5.42 | |
| 78 | 0.7 | 0.05 | 99.37 | 69.99 | | | |
| 74.5 | 0.7 | 0.15 | 99.98 | 84.98 | 1.80 | 8.47 | |

EXAMPLE 43

In this example, samples from several coal seams were each milled in one step from a 4×0 mesh feedstock to high solids slurry with about 98.5% <50 mesh (300 microns). Each of these tests were made under the same standard conditions in the 16 inch Abbe ball mill as cited in Example 43. Variations made in grinding conditions were chemical additives and solids content. The coals used are summarized in Table 16. The conditions of grinding and resulting slurries are summarized in Table 17.

TABLE 16

| Seam and Place of Origin | Volatiles % (dry basis) | Ash % | HGI | FSI |
|---|---|---|---|---|
| Moss #1 Virginia | 32.18 | 7.4 | 70+ | 8.0 |
| C. Seam M. Kittanning Pennsylvania | 38.8 | 3.8 | 51 | — |
| Upper Freeport Pennsylvania | 29.1 | 14.3 | 78 | 7.0 |
| L. Kitt./Dorothy W. Virginia | 35.8 | 6.5 | 46 | 7.5 |
| Pittsburgh Pennsylvania | 31.6 | 12.6 | 60 | 7.0 |

TABLE 17

| Grinding Conditions | | | Product Slurry | | | | |
|---|---|---|---|---|---|---|---|
| Weight % solids | Lomar D % | NaOH % | % <50 M | % <200 M | S.A. $m^2/cm^3$ | Poros. % | Bingham Viscos. cP |
| | | | Moss #1 | | | | |
| 75 | 0.935 | 0.134 | 98.70 | 62.53 | 0.933 | 14.74 | — |
| 73 | 0.96 | 0.137 | 99.01 | 63.96 | 0.826 | 9.40 | — |
| 78 | 0.7 | 0.1 | 98.28 | 64.44 | 1.15 | 11.07 | 1500 @ 75% |
| 78 | 0.96 | 0.137 | 98.73 | 65.18 | 1.092 | 8.88 | 1550 @ 75% |
| 78 | 0.7 | 0.15 | 99.03 | 67.21 | 1.312 | 8.29 | 1450 @ 75% |
| | | | Middle Kittanning | | | | |
| 73 | 0.96 | 0.137 | 98.64 | 65.02 | 1.251 | 5.50 | — |
| 73 | 0.7 | 0.1 | 99.07 | 64.55 | 0.969 | 7.50 | 1450 @ 70% |
| 73 | 0.9 | 0.1 | 99.17 | 66.36 | 0.906 | 10.33 | 1750 @ 70% |
| | | | Upper Freeport | | | | |
| 75 | 0.7 | 0.1 | 98.84 | 66.12 | 1.456 | 6.44 | 2100 @ 75% |
| 78 | 0.7 | 0.1 | 97.80 | 63.50 | 1.260 | 5.11 | 1300 @ 75% |
| 78/75 | 0.72 | 0.13 | 99.80 | 71.48 | 1.037 | 12.19 | 2500 @ 75% |
| | | | Dorothy | | | | |
| 75 | 0.7 | 0.1 | 99.22 | 64.21 | 1.141 | 5.67 | 530 @ 68.5% |
| | | | Pittsburg | | | | |
| 75 | 0.7 | 0.1 | 98.49 | 65.18 | 1.312 | 5.18 | 1000 @ 70% |
| 75 | 0.7 | 0.1 | 99.43 | 67.16 | 1.578 | 8.72 | 1100 @ 70% |

EXAMPLE 44

In this example, various surfactants and combinations of surfactants were used during the milling to produce slurry. Mill parameters were identical to those cited in Examples 42 and 43. These slurries were made with coals cited in Example 43. The properties of these coals are summarized in Table 18. The slurry properties are summarized in Table 19.

TABLE 18

| Seam and Place of Origin | Volatiles % (dry basis) | Ash % | HGI | FSI |
|---|---|---|---|---|
| Upper Freeport Pennsylvania | 29.1 | 14.3 | 78 | 7.0 |
| L. Kitt./Dorothy W. Virginia | 35.8 | 6.5 | 46 | 7.5 |

TABLE 19

| Grinding Conditions | | Product Slurry | | | | |
|---|---|---|---|---|---|---|
| Weight % solids | % Chemical | % <50 M | % <200 M | S.A. $m^2/cm^3$ | Poros. % | Bingham Viscos. cP |
| | | Upper Freeport | | | | |
| 78 | 0.7% Lomar D 0.1% NaOH | 97.80 | 63.50 | 1.26 | 5.11 | 1300 @ 75% |
| 78 | 0.7% A-23 0.1% NaOH | 99.16 | 68.21 | 1.21 | 6.39 | 2300 @ 75% |
| 78 | 0.7% A-23 0.05% CW-11 0.1% NaOH | 99.30 | 68.35 | 1.46 | 5.69 | 3400 @ 75% |
| 78 | 0.6% NALCO JM006 | 99.04 | 66.59 | 1.56 | 13.30 | 2250 @ 75% |
| | | Lower Kittaning/Dorothy | | | | |
| 75 | 0.7% Lomar D 0.1% NaOH | 98.06 | 62.89 | 1.68 | 6.08 | 720 @ 70% |
| 75 | 0.7% Lomar PW 0.1% NaOH | 97.60 | 61.74 | 1.46 | 6.36 | 720 @ 71% |

The Nalco JM006 is the sodium salt of polyacrylic acid as is described in this specification. "A-23" is a condensed naphthalene sulfonic acid which is similar to Lomar D and which also is produced by the Diamond Shamrock Company.

In substantial accordance with the procedure of this EXAMPLE 44, stable slurries were prepared using low-volatile Upper Freeport coal and other organic surfactants. The organic surfactants evaluated are listed below in decreasing order of effectiveness in Table 20.

TABLE 20

| Trade name of Surfactant | Manufacturer | Chemical Identity |
|---|---|---|
| Nopcosperse VFG | Diamond Shamrock Co. | Condensed alkyl naphthalene sulfonate |
| Texo LP583 | Texo Corporation | alkyl aryl sulfonate |
| Americo SD-1 | American Can Co. | lignosulfonate |
| Darvan #1 | R. T. Vanderbilt, Inc. | polymerized benzene sulfonate |
| Darvan #6 | R. T. Vanderbilt, Inc. | polymerized benzene sulfonate |
| Texo LP 581 | Texo Corporation | alkyl aryl sulfonate |
| Lignosol | Reed Ltd. | lignosulfonate |

TABLE 20-continued

| Trade name of Surfactant | Manufacturer | Chemical Identity |
|---|---|---|
| NSX 135 | | |
| Marasperse CBOS-3 | American Can Co. | lignosulfonate |
| Reax 8813 | Westavco Company | lignosulfonate |
| Nopcosperse VEO-1 | Diamond Shamrock Co. | polymerized alkyl naphthalene sulfonate |
| Petro 425LS | Petro Chemicals Co. | alkyl aryl sulfonate |
| Polyfon O | Westavco Company | lignosulfonate |
| Reax 15B | Westavco Company | lignosulfonate |
| Darvan #2 | R. T. Vanderbilt, Inc. | polymerized benzene sulfonate |
| NORLIG 42Z | American Can Co. | lignosulfonate |

EXAMPLE 45-60

Medium volatile upper Freeport coal was used to prepare a coal-water slurry in accordance with this invention which contained 72.53 weight percent of coal solids had a consist specific surface area of 1.426 square meters per cubic centimeter, had a consist porosity of 7.741 volume percent, had a$_1$ Haake viscosity of 1300 centipoise at 100 sec., and had a yield stress of 2.5 Pascals;, and had a median size of 41.77 microns.

Varying amounts of different stabilizing agents which were chosen for their prospective ability to affect the zeta potential of the colloidal sized coal particles, were added to the slurry, and the slurry was then retested. Table 21 presents the results of these experiments.

TABLE 21

| EXAMPLE # | Additive Name | Additive conc. Wt % by wt. of dry coal | Haake visc. at 100 $s^{-1}$ | Yield Stress Pa |
|---|---|---|---|---|
| 45 | None | 0 | 1300 | 2.5 |
| 46 | Polyvinylacetate | 0.00345 | 2225 | 6.0 |
| 47 | Polyvinylacetate | 0.00863 | 3000 | 16.5 |
| 48 | Methylcellulose powder (std. 15 cps) | 0.00190 | 1450 | 3.0 |
| 49 | Methylcellulose powder (Methocel MC) | 0.00475 | 1650 | 3.0 |
| 50 | Methylcellulose powder | 0.00792 | 2000 | 11.0 |
| 51 | Methylcellulose powder | 0.00817 | 2150 | 8.0 |
| 52 | Methylcellulose powder | 0.00485 | 2100 | 17.5 |
| 53 | Methylcellulose powder | 0.00204 | 1800 | 4.0 |
| 54 | Methocel HG 90 | 0.00199 | 1700 | 5.0 |
| 55 | Methocel HG 90 | 0.00294 | 2050 | 6.0 |

TABLE 21-continued

| EXAMPLE # | Additive Name | Additive conc. Wt % by wt. of dry coal | Haake visc. at 100 $s^{-1}$ | Yield Stress Pa |
|---|---|---|---|---|
| 56 | Cellosize (Hydroxy-ethyl cellulose) QP-300 | 0.00817 | 3200 | 13.0 |
| 57 | Cellosize QP-300 | 0.00163 | 1700 | 5.0 |
| 58 | Cellosize QP-300 | 0.00327 | 2400 | 5.0 |
| 59 | Kelzon S | 0.00158 | 1600 | 5.0 |
| 60 | Kelzon S | 0.00317 | 2000 | 5.0 |

EXAMPLE 61-65

As described in EXAMPLE 45, medium volatile upper Freeport coal was used to prepare a coal-water slurry in accordance with this invention which contained 74.52 weight percent of coal solids, had a consist specific surface area of 1.3915 square meters per cubic centimeter, had a consist porosity of 5.839 volume percent, had a Haake viscosity of 2300 centipoise at 100 sec.$^{-1}$, had a yield stress of 5.0 Pascals, and had a median size of 26.989 microns.

Varying amounts of different stabilizing agents, which were chosen for their prospective ability to affect the zeta potential of the colloidal size coal particles in thef slurry, were added to the slurry, and the slurry was then retested. Table 22 presents the results of these experiments.

TABLE 22

| EXAMPLE # | Additive Name | Additive conc. Wt % by wt. of dry coal | Haake visc. 100 $sec^{-1}$ | Yield Stress Pa |
|---|---|---|---|---|
| 61 | None | 0 | 2300 | 5.0 |
| 62 | Calcium Chloride | 0.0258 | 2315 | 8.0 |
| 63 | Calcium Chloride | 0.0343 | 2330 | 9.0 |
| 64 | Acetic Acid | 0.0279 | 2350 | 11.0 |
| 65 | Acetic Acid | 0.0372 | 2450 | 12.0 |

Other organic and inorganic compounds which are water soluble and affect the zeta potential of the colloidal coal particles also may be used to affect the zeta potential and yield stress of the system. In general, when an organic stabilizer is used, from about 0.001 to about 0.5 weight percent, based on weight percent of dry coal, can be used.

The preferred inorganic stabilizers are the water-soluble salts of calcium, magnesium, and aluminum (plus three valence). Some suitable salts include, e.g., calcium chlorite, calcium chlorate, calcium chloride, calcium perchlorate, calcium sulfate, calcium hydroxide, calcium iodide, calcium nitrate, magnesium sulfate, magnesium chloride, magnesium citrate, magnesium hypophosphite, aluminum chloride, aluminum nitrate, aluminum sulfate, mixtures of the aforementioned salts, and the like. Some preferred organic stabilizers include, e.g., acetic acid, propionic acid, acid, and other mono-carboxylic acids containing from 2 to 9 carbon atoms. Mineral acids, such as hydrochloric acid, nitric acid, and sulfuric acid, also will work.

EXAMPLE 66

In substantial accordance with the procedure described in EXAMPLE 65, an Upper Freeport coal slurry comprised of 0.04 weight percent acetic acid was prepared; the slurry contained 75 weight percent of coal.

A 55 gallon drum containing this slurry was shipped across the Atlantic Ocean from Philadelphia, Pennsylvania to Italy. Five samples (1-5) were taken from the top inch of slurry at the top of the drum, and one sample (#6) was taken from the bottom inch of the slurry at the bottom of the barrel. The percent solids of these samples, after the transatlantic shipping, in weight percent, is shown below.

| | Sample No. | % Solids |
|---|---|---|
| Top | 1 | 73.58 |
| | 2 | 73.83 |
| | 3 | 73.74 |
| | 4 | 74.34 |
| | 5 | 74.38 |
| Bottom | 6 | 74.82 |

EXAMPLES 67-71

In substantial accordance with the procedure described in EXAMPLE 65, coal-water slurries stabilized with acetic acid which had different solids contents, yield stresses, and viscosities were poured into gallon jars and transported varying distances in an automobile, after which it was determined what type of settling, if any, occurred in the samples. Table 23 summarizes the results of these experiments.

TABLE 23

| EXAMPLE # | Coal in slurry | Wt % solids in slurry | Yield Stress Pa | Bingham Viscos. cps | Miles slurry transported in auto | Settling |
|---|---|---|---|---|---|---|
| 67 | Upper Freeport | 75.0 | 7.0 | 1100 | 1200 | Softpack |
| 68 | Upper Freeport | 70.0 | 2.2 | 220 | 1200 | Softpack |
| 69 | Upper Freeport | 79.3 | 20.0 | 4500 | 250 | None |
| 70 | Upper Freeport | 75.0 | 6.5 | 960 | 250 | Softpack |
| 71 | Pittsburg #8 | 69.8 | 3.8 | 900 | 250 | Semi-hard pack |

Slurries comprised of non-carbonaceous solids and liquid also can be made by the process of this invention in accordance with the aforementioned CPFT and stability formulae. Thus, instead of coal or coke, e.g., one can use such non-carbonaceous solids as ceramic powders comprised of aluminosilicates such as clays and fieldspars, anf flint, alumina, bauxite, chromites, magnesites, silicon carbide, and the like; metalliferous ores such as copper ores, iron ores, and the like; non-metallic minerals such as, e.g., talc, limestone, dolomite, and the like. The ores described on pages 8–47 to 8–48 of Perry & Chilton's "*Chemical Engineers Handbook,*" Fifth Edition (McGraw Hill, New York, 1973) can be used in applicant's process to prepare stable slurries; the disclosure of said portion of said bulk is hereby incorporated by reference into this specification.

It is to be understood that the foregoing description and Examples are illustrative only and that changes can be made in the ingredients and their proportions and in the sequence and combination of process steps as well as other aspects of the invention discussed without departing from the scope and spirit of the invention as defined in the following claims.

I claim:

1. A process for preparing a clean coal-water slurry, comprising the steps of:
   (a) providing a coal-water mixture comprised of from about 60 to about 80 volume percent of solids;
   (b) grinding said coal-water mixture until a coal-water slurry is produced wherein:
      1. said slurry has a yield stress of from about 3 to about 18 Pascals and a Brookfield viscosity at a solids content of 70 volume percent, ambient temperature, ambient pressure, and a shear rate of 100 revolutions per minute, of less than 5,000 centipoise;
      2. said slurry is comprised of a consist of finely divided particles of coal dispersed in water, and said consist has a specific surface area of from about 0.8 to about 4.0 square meters per cubic centimeter and an interstitial porosity of less than about 20 volume percent;
      3. from about 5 to about 70 weight percent of said finely divided particles of coal in said water are of colloidal size, being smaller than about 3.0 microns;
      4. said consist of finely divided particles of coal has a particle size distribution substantially in accordance with the following formula:

$$\frac{CPFT}{100} = \sum_{j=1}^{k}\left[X_j\left(\frac{D^{Nj} - D_{sj}^{Nj}}{D_{Lj}^{Nj} - D_{sj}^{Nj}}\right)\right]$$

$$\text{where } \sum_{j=1}^{k} X_j = 1.0$$

$$\text{and where if } D < D_{sj}\left(\frac{D^{Nj} - D_{sj}^{Nj}}{D_{Lj}^{Nj} - D_{sj}^{Nj}}\right) = 0.0$$

$$\text{and where if } D > D_{Lj}\left(\frac{D^{Nj} - D_{sj}^{Nj}}{D_{Lj}^{Nj} - D_{sj}^{Nj}}\right) = 1.0$$

wherein:
   (a) CPFT is the cumulative percent of said solid carbonaceous material finer than a certain specified particle size D, in volume percent;
   (b) k is the number of component distributions in the compact and is at least 1;
   (c) $X_j$ is the fractional amount of the component j in the compact, is less than or equal to 1.0, and the sum of all of the $X_{js}$ in the consist is 1.0;
   (d) N is the distribution modulus of fraction j and is greater than about 0.001;
   (e) D is the diameter of any particle in the compact and ranges from about 0.05 to about 1180 microns;
   (f) $D_s$ is the diameter of the smaller particle in fraction j, as measured at 1% CPFT on a plot of CPFT versus size D, is less than $D_L$, and is greater than 0.05 microns; and
   (g) $D_L$ is the diameter of the size modulus in fraction j, measured by sieve size or its equivalent, and is from about 15 to about 1180 microns;
      5. at least about 85 weight percent of the coal particles in the consist have a particle size less than about 300 microns; and
      6. the net zeta potential of said colloidal sized particles of coal is from about 15 to about 85 millivolts; and
   (c) cleaning said coal.

2. The process as recited in claim 1, wherein said k is 1.

3. The process as recited in claim 2, wherein from about 5 to about 30 weight percent of said finely divided particles of coal in said water are of colloidal size.

4. The process as recited in claim 3, wherein:
   (a) said consist has a specific surface area of from about 0.8 to about 3.0 square meters per cubic centimeter,
   (b) said consist has an interstitial porosity of less than about 15 volume percent,
   (c) said N is from about 0.001 to about 10, and
   (d) at least about 90 weight percent of the coal particles in the consist have a particle size less than about 300 microns.

5. The process as recited in claim 4, wherein:
   (a) said consist has a specific surface area of from about 0.8 to about 2.4 square meters per cubic centimeter,
   (b) said consist has an interstitial porosity of less than about 10 volume percent,
   (c) said N is from about 0.01 to about 1.0, and
   (d) at least about 95 weight percent of the coal particles in the consist have a particle size less than about 300 microns.

6. The process as recited in claim 5, wherein said compact has a specific surface area of from about 0.8 to about 2.0 square meters per cubic centimeter, and said N is from about 0.01 to about 0.5.

7. The process as recited in claim 6, wherein said coal is cleaned by cleaning said coal-water mixture provided in step (a) prior to the time said mixture is ground in step (b).

8. The process as recited in claim 6, wherein said coal is cleaned by cleaning the coal-water slurry produced in step (b).

9. A process for preparing a clean coal-water slurry, comprising the steps of:
   (a) blending a coal-water mixture with at least one additional coal fraction selected from the group consisting of coal, coal-water mixture, and mixtures thereof, until a coal-water slurry is produced wherein:

1. said slurry contains from about 60 to about 80 volume percent of coal;
2. said slurry has a yield stress of from about 3 to about 18 Pascals and a Brookfield viscosity at a solids content of 70 volume percent, ambient temperature, ambient pressure, and a shear rate of 100 revolutions per minute, of less than 5,000 centipoise;
3. said slurry is comprised of a consist of finely divided particles of coal dispersed in water, and said consist has a specific surface area of from about 0.8 to about 4.0 square meters per cubic centimeter and an interstitial porosity of less than about 20 volume percent;
4. from about 5 to about 70 weight percent of said finely divided particles of coal in said water are of colloidal size, being smaller than about 3.0 microns;
5. said consist of finely divided particles of coal has a particle size distribution substantially in accordance with the following formula:
6. at least about 85 weight percent of the coal particles in the consist have a particle size less than about 300 microns; and
7. the net zeta potential of said colloidal sized particles of coal is from about 15 to about 85 millivolts; and (b) cleaning said coal.

10. The process as recited in claim 9, wherein said k is 1.

11. The process as recited in claim 10, wherein from about 5 to about 30 weight percent of said finely divided particles of coal in said water are of colloidal size.

12. The process as recited in claim 11, wherein:

(a) said consist has a specific surface area of from about 0.8 to about 3.0 square meters per cubic centimeter,
(b) said consist has an interstitial porosity of less than about 15 volume percent,
(c) said N is from about 0.001 to about 10, and
(d) at least about 90 weight percent of the coal particles in the consist have a particle size less than about 300 microns.

13. The process as recited in claim 12, wherein:

(a) said consist has a specific surface area of from about 0.8 to about 2.4 square meters per cubic centimeter,
(b) said consist has an interstitial porosity of less than about 10 volume percent,
(c) said N is from about 0.01 to about 1.0, and
(d) at least about 95 weight percent of the coal particles in the consist have a particle size less than about 300 microns.

14. The process as recited in claim 13, wherein said compact has a specific surface area of from about 0.8 to about 2.0 square meters per cubic centimeter, and said N is from about 0.01 to about 0.5.

15. The process as recited in claim 14, wherein said coal is cleaned by cleaning the coal-water slurry produced in step (a).

* * * * *